US011477556B2

(12) United States Patent
Watanabe et al.

(10) Patent No.: US 11,477,556 B2
(45) Date of Patent: Oct. 18, 2022

(54) SOUND COLLECTING DEVICE

(71) Applicant: SONY CORPORATION, Tokyo (JP)

(72) Inventors: Ryutaro Watanabe, Tokyo (JP); Tsutomu Toyoguchi, Tokyo (JP); Toru Nakagawa, Tokyo (JP); Go Igarashi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/250,396

(22) PCT Filed: May 9, 2019

(86) PCT No.: PCT/JP2019/018584
§ 371 (c)(1),
(2) Date: Jan. 15, 2021

(87) PCT Pub. No.: WO2020/021815
PCT Pub. Date: Jan. 30, 2020

(65) Prior Publication Data

US 2021/0258670 A1 Aug. 19, 2021

(30) Foreign Application Priority Data

Jul. 24, 2018 (JP) ..... JP2018-138661

(51) Int. Cl.
*H04R 1/08* (2006.01)
*H04R 1/10* (2006.01)

(52) U.S. Cl.
CPC ..... *H04R 1/08* (2013.01); *H04R 1/1016* (2013.01)

(58) Field of Classification Search
None
See application file for complete search history.

(56) References Cited

U.S. PATENT DOCUMENTS

2011/0098787 A1 4/2011 Spearman et al.
2018/0113673 A1* 4/2018 Sheynblat ..... G10L 17/00
2018/0176702 A1* 6/2018 Boyle ..... H04R 25/407

FOREIGN PATENT DOCUMENTS

JP 2004-128854 A 4/2004
JP 2008-512015 A 4/2008
(Continued)

OTHER PUBLICATIONS

International Search Report and Written Opinion of PCT Application No. PCT/JP2019/018584 dated Jul. 30, 2019, 07 pages of ISRWO.

*Primary Examiner* — Kenny H Truong
(74) *Attorney, Agent, or Firm* — Chip Law Group

(57) ABSTRACT

Provided is a sound collecting device in which sound is favorably input to a sound collecting unit. The sound collecting device includes an attachment portion that has a sound collecting unit attached and is adapted to be inserted into an external ear canal, a holding portion adapted to be inserted into the external ear canal and hold the attachment portion at a predetermined position in the external ear canal, and a wearing portion that is positioned on an opposite side of the attachment portion while interposing the holding portion and adapted to be at least partly engaged with an auricle, in which the attachment portion and the holding portion do not block the external ear canal and have acoustic transparency. Further, the attachment portion and the holding portion are positioned in the ear in a state of not blocking the external ear canal.

20 Claims, 25 Drawing Sheets

(56) References Cited

FOREIGN PATENT DOCUMENTS

| | | | |
|---|---|---|---|
| WO | 2011/056202 | A1 | 5/2011 |
| WO | 2018/123252 | A1 | 7/2018 |

* cited by examiner

SOUND COLLECTING DEVICE

CROSS REFERENCE TO RELATED APPLICATIONS

This application is a U.S. National Phase of International Patent Application No. PCT/JP2019/018584 filed on May 9, 2019, which claims priority benefit of Japanese Patent Application No. JP 2018-138661 filed in the Japan Patent Office on Jul. 24, 2018. Each of the above-referenced applications is hereby incorporated herein by reference in its entirety.

TECHNICAL FIELD

The present technology relates to a technical field of a sound collecting device used by being worn on a user's ear.

BACKGROUND ART

Recently, an in-the-ear type sound collecting device used by being worn on a user's ear has been widely used. As a recording method in the in-the-ear type sound collecting device, it is possible to exemplify binaural recording, for example. The binaural recording is to record sound nearly in a state of reaching an eardrum of each user in consideration of individual differences in shapes and the like of a head, a body, and an earlobe of each user.

When the sound recorded by the binaural recording is listened to by earphones or headphones, it is possible to reproduce a realistic feeling as if he/she is at a site of the recording. Furthermore, it is possible to acquire, on the basis of a sound signal obtained by the binaural recording, a head-related transfer function (HRTF) that expresses a sound change caused by influence of diffraction and reflection according to each site of a human body, such as a head, a body, an earlobe, and the like of each user. For example, an audio image is virtually localized and the realistic feeling can be reproduced by convolving the head-related transfer function with a sound signal played back from a normal sound source (dry source).

Furthermore, as another use of the in-the-ear type sound collecting device, it is possible to exemplify noise canceling in combination with a wearable type acoustic output device such as earphones or headphones, for example.

As for the technology in which the binaural recording is performed by using an in-the-ear type sound collecting device, there are some proposed technologies (see, for example, Patent Document 1 and Patent Document 2).

CITATION LIST

Patent Document

Patent Document 1: Japanese Patent Application Laid-Open No. 2004-128854

Patent Document 2: Japanese Translation of PCT International Application Publication No. 2008-512015

SUMMARY OF THE INVENTION

Problems to be Solved by the Invention

By the way, many of in-the-ear type sound collecting devices that perform binaural recording have a sealed structure in which a sound collecting unit such as a microphone is arranged outside an external ear canal of a user, and furthermore, a device main body that holds the sound collecting unit almost completely blocks an ear hole of the user.

Accordingly, there is a possibility that the sound is not favorably input to the sound collecting unit. In particular, when propagation of sound waves is hindered or the sound waves are reflected or diffracted, accurate measurement of a head-related transfer function may be obstructed.

Considering this, the present technology is directed to providing a sound collecting device in which sound is favorably input to the sound collecting unit.

Solutions to Problems

First, the sound collecting device according to the present technology includes: an attachment portion that has a sound collecting unit attached and is adapted to be inserted into an external ear canal; a holding portion adapted to be inserted into the external ear canal and hold the attachment portion at a predetermined position in the external ear canal; and a wearing portion that is positioned on an opposite side of the attachment portion while interposing the holding portion, and adapted to be at least partly engaged with an auricle, in which the attachment portion and the holding portion do not block the external ear canal and have acoustic transparency.

With this configuration, the attachment portion that has the sound collecting unit attached and is adapted to be inserted into the external ear canal, and the holding portion adapted to hold the attachment portion at the predetermined position in the external ear canal are positioned in an ear in a state of not blocking the external ear canal.

Secondly, in the above-described sound collecting device, it is desirable that the attachment portion be held in midair in the external ear canal.

With this configuration, the attachment portion hardly contacts a wall surface forming the external ear canal.

Thirdly, in the above-described sound collecting device, it is desirable that the sound collecting unit be positioned in a state in which a sound input hole is opened to an entrance side of the external ear canal.

With this configuration, sound to be input to the external ear canal is surely and smoothly input to the sound collecting unit.

Fourth, in the above-described sound collecting device, it is desirable that the sound collecting unit have the sound input hole positioned on an eardrum side with respect to the entrance of the external ear canal.

With this configuration, the sound to be input to the external ear canal is surely input to the sound collecting unit.

Fifth, in the above-described sound collecting device, it is desirable that the attachment portion and the holding portion be integrally formed.

With this configuration, work of joining the attachment portion and the holding portion is not necessary.

Sixth, in the above-described sound collecting device, it is desirable that the holding portion and the wearing portion be integrally formed.

With this configuration, work of joining the holding portion and the wearing portion is not necessary.

Seventh, in the above-described sound collecting device, it is desirable that the attachment portion be formed in a predetermined shape by using a linear material.

With this configuration, a thickness of the attachment portion is thin, and reflection or diffraction of sound waves by the attachment portion hardly occurs.

Eighth, in the above-described sound collecting device, it is desirable that the attachment portion be formed in a coil shape.

With this configuration, volume of the attachment portion is small, and reflection or diffraction of sound waves by the attachment portion hardly occurs.

Ninth, in the above-described sound collecting device, it is desirable that the sound collecting unit be positioned inside the attachment portion.

With this configuration, the sound collecting unit is held in midair in the external ear canal and does not contact the wall surface forming the external ear canal.

Tenth, in the above-described sound collecting device, it is desirable that the sound collecting unit be detachable from the attachment portion.

With this configuration, the sound collecting unit is replaceable with respect to the attachment portion.

Eleventh, in the above-described sound collecting device, it is desirable that the holding portion be formed in a predetermined shape by using a linear material.

With this configuration, a thickness of the holding portion is thin, and reflection or diffraction of sound waves by the holding portion hardly occurs.

Twelfth, in the above-described sound collecting device, it is desirable that the holding portion be formed in a coil shape.

With this configuration, volume of the holding portion is small, and reflection or diffraction of sound waves by the holding portion hardly occurs.

Thirteenth, in the above-described sound collecting device, it is desirable that the holding portion be elastically deformable.

With this configuration, the holding portion is slid on the wall surface forming the external ear canal and can be inserted into the external ear canal while being deformed.

Fourteenth, in the above-described sound collecting device, it is desirable that the holding portion have an outer shape that becomes gradually smaller as a position of the holding portion approaches the attachment portion.

With this configuration, when the attachment portion and the holding portion are inserted into the external ear canal, the holding portion is inserted from a side having the smaller outer shape.

Fifteenth, in the above-described sound collecting device, it is desirable that the wearing portion be formed in a predetermined shape by using a linear material.

With this configuration, a thickness of the wearing portion is thin, and reflection or diffraction of sound waves by the wearing portion hardly occurs.

Sixteenth, in the above-described sound collecting device, it is desirable that: the wearing portion be provided with an inner engagement portion continuous to the holding portion and adapted to be at least partly engaged with the auricle; and the inner engagement portion be formed in a coil shape.

With this configuration, volume of the inner engagement portion is small, and reflection or diffraction of sound waves by the inner engagement portion hardly occurs.

Seventeenth, in the above-described sound collecting device, it is desirable that: the wearing portion be provided with an inner engagement portion continuous to the holding portion and adapted to be at least partly engaged with the auricle; the inner engagement portion be elastically deformable in a direction contacting and separating from the holding portion; and the inner engagement portion be positioned in a cavum conchae.

With this configuration, the inner engagement portion is positioned in the cavum conchae in a state of being pressed against a part of the auricle.

Eighteenth, in the above-described sound collecting device, it is desirable that: the wearing portion be provided with an inner engagement portion continuous to the holding portion and adapted to be at least partly engaged with the auricle; and an outer diameter of the inner engagement portion be formed larger than a diameter of the entrance of the external ear canal.

With this configuration, the inner engagement portion is prevented from being inserted into the external ear canal.

Nineteenth, in the above-described sound collecting device, it is desirable that the wearing portion be provided with an outer engagement portion adapted to be partly engaged with a back surface of the auricle.

With this configuration, the sound collecting device is worn on an ear by the inner engagement portion engaging with a part of the auricle and the outer engagement portion engaging with the back surface of the auricle.

Twentieth, in the above-described sound collecting device, it is desirable that: the outer engagement portion be provided with a pair of acting portions; the outer engagement portion be elastically deformable in a direction in which the pair of acting portions contacts and separates from each other; and one of the acting portions be pressed against the back surface of the auricle.

With this configuration, one acting portion and the other acting portion are elastically deformed so as to separate from each other to make the outer engagement portion in an opened state, and the sound collecting device can be worn on the ear by inserting the auricle between the pair of opened acting portions.

Effects of the Invention

According to the present technology, it is possible to provide the sound collecting device in which sound is favorably input to the sound collecting unit because the attachment portion that has the sound collecting unit attached and is adapted to be inserted into an external ear canal, and a holding portion adapted to hold the attachment portion at the predetermined position in the external ear canal are positioned in an ear in the state of not blocking the external ear canal.

Note that the effects described in the present specification are merely examples and not limited thereto, and additional effects may also be provided.

MODE FOR CARRYING OUT THE INVENTION

In the following, a mode for carrying out a sound collecting device of the present technology will be described with reference to the attached drawings.

<Structure of Ear>

Figure 1:
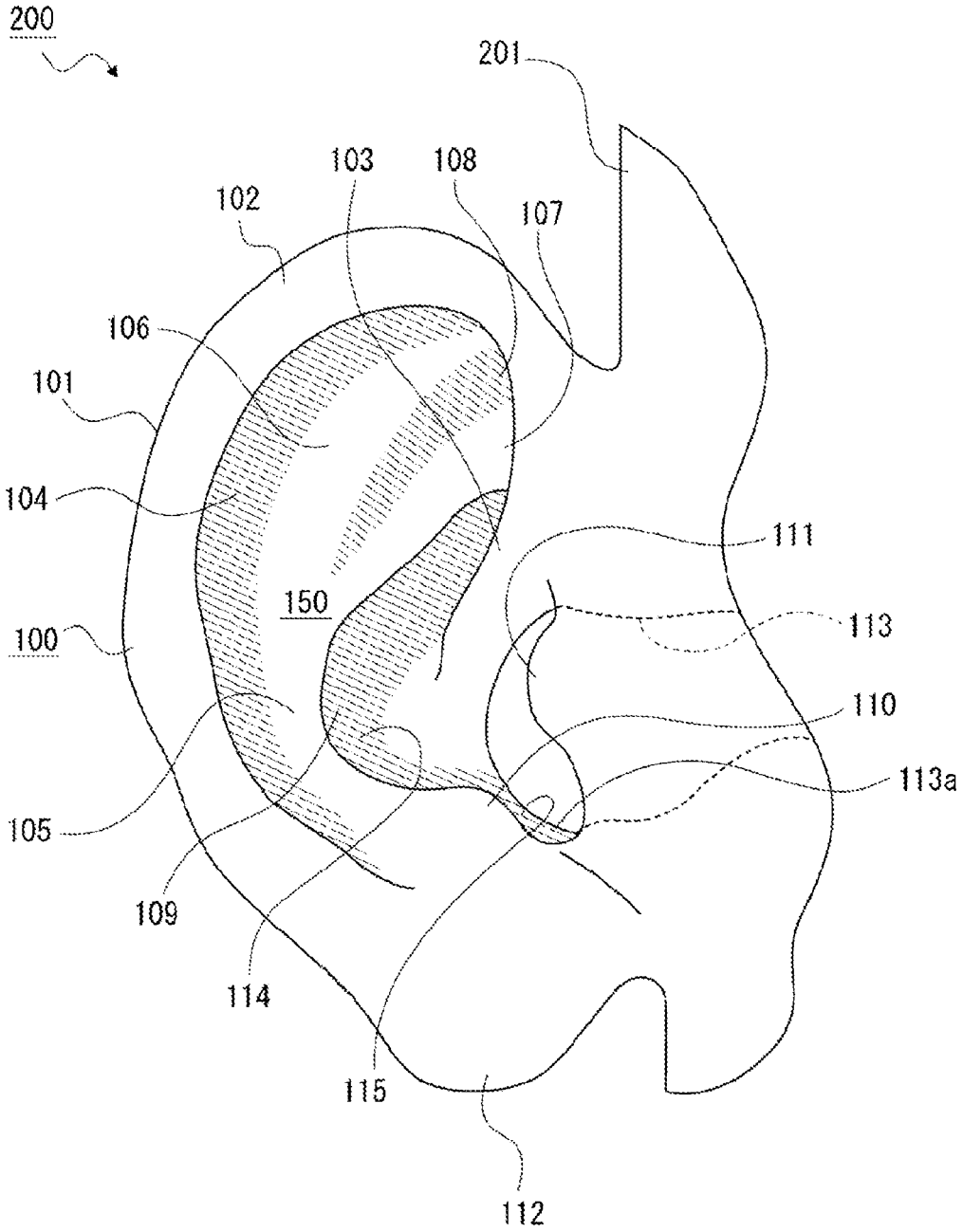
FIG. 1 illustrates, together with FIGS. 2 to 35, an embodiment of a sound collecting device of the present technology, and the present drawing is a perspective view of an ear on which the sound output device is worn.
Figure 2:
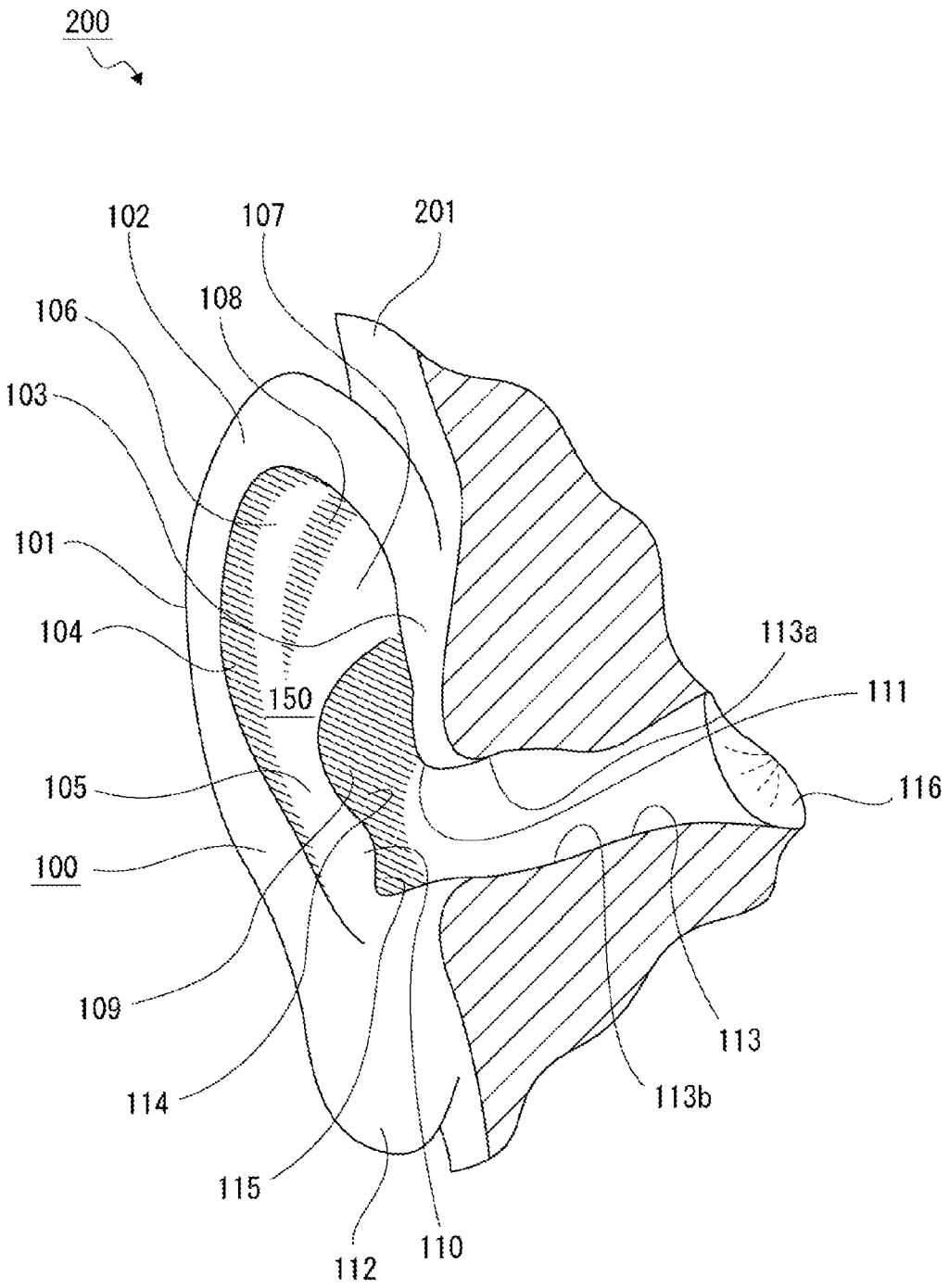
FIG. 2 is a perspective view partly illustrating a cross-section of the ear.

First, a structure of an ear on which a sound collecting device is worn will be described (see FIGS. 1 and 2).

Ears 100 and 100 partly constitute a head 200, and include auricles 101 and 101, and each includes an eardrum, a semicircular canal, a cochlea, and the like existing inside the head 200. In the head 200, inner portions of the respective auricles 101 and 101 are temporal regions 201 and 201, and each of the auricles 101 and 101 protrudes to a left side or a right side from each of the temporal regions 201 and 201.

Each auricle 101 has a shallow recessed shape opened in a substantially front direction as a whole so as to have an internal space 150, and an outer peripheral portion thereof includes: a portion called a helix 102; and a portion continuous to the helix 102, positioned near the temporal region 201, and called a helical crus 103.

An inner portion of the helix 102 is called a scaphoid fossa 104 having a recessed shape, and a substantially lower-half portion inside the scaphoid fossa 104 is called an antihelix 105 having a projecting shape. There is a portion continuous to the antihelix 105 and having a bifurcating and projecting shape above the antihelix 105, and an outer portion and an inner portion of this bifurcating portion are called an antihelix superior crus 106 and an antihelix inferior crus 107, respectively. A portion between the antihelix superior crus 106 and the antihelix inferior crus 107 is called a triangular fossa 108 and an inner portion of the antihelix 105 and the antihelix inferior crus 107 is called a cymba conchae 109 having a recessed shape.

A portion continuous to a lower side of the antihelix 105 slightly bulges to the temporal region 201 side and is a portion called an antitragus 110. A portion facing the antitragus 110 and positioned on the temporal region 201 side is called a tragus 111 that slightly bulges to the antitragus 110 side, and a lower end portion continuous to a lower side of the helix 102 is called an earlobe 112.

An external acoustic foramen 113*a* that is an entrance of an external ear canal 113 exists between the antitragus 110 and the tragus 111, and the external ear canal 113 communicates with the eardrum, the semicircular canal, and the like. In the internal space 150 of the auricle 101, a space surrounded by the antihelix 105, the antihelix inferior crus 107, and the helical crus 103, that is, a space on a front side of the cymba conchae 109 is called a cavum conchae 114 and communicates with the external acoustic foramen 113*a* of the external ear canal 113. In the internal space 150, a space continuous to a lower side of the cavum conchae 114 and opened in a U shape is a space called an incisura intertragica 115.

The external ear canal 113 is a space surrounded by a wall surface 113*b*, and there is an eardrum 116 on a deep side of the external ear canal 113.

The internal space 150 of the auricle 101 includes the cavum conchae 114, the incisura intertragica 115, and a space in the vicinity of the external acoustic foramen 113*a* of the external ear canal 113, and also is a space including a space on the front side of the scaphoid fossa 104, the antihelix 105, the antihelix superior crus 106, the antihelix inferior crus 107, the triangular fossa 108, the antitragus 110, and the tragus 111.

<Configuration of Sound Collecting Device>

Next, a configuration of the sound collecting devices 1 and 1 will be described (see FIGS. 3 to 9). In the sound collecting devices 1 and 1, one is used for a left ear 100 and the other one is used for a right ear 100. However, note that either one of the sound collecting devices 1 may be used.

Figure 3:
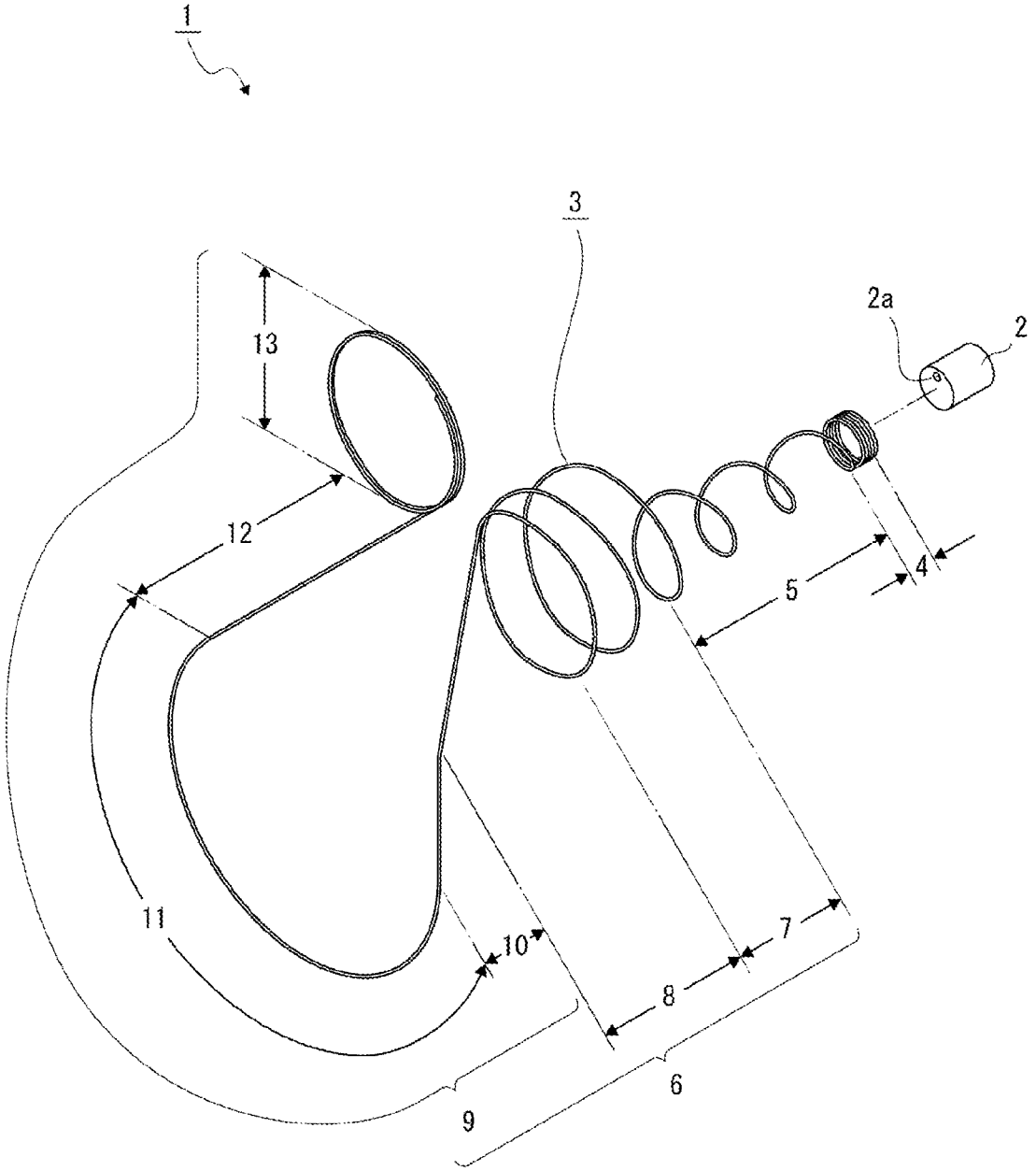
FIG. 3 is a perspective view of the sound collecting device.
Figure 4:
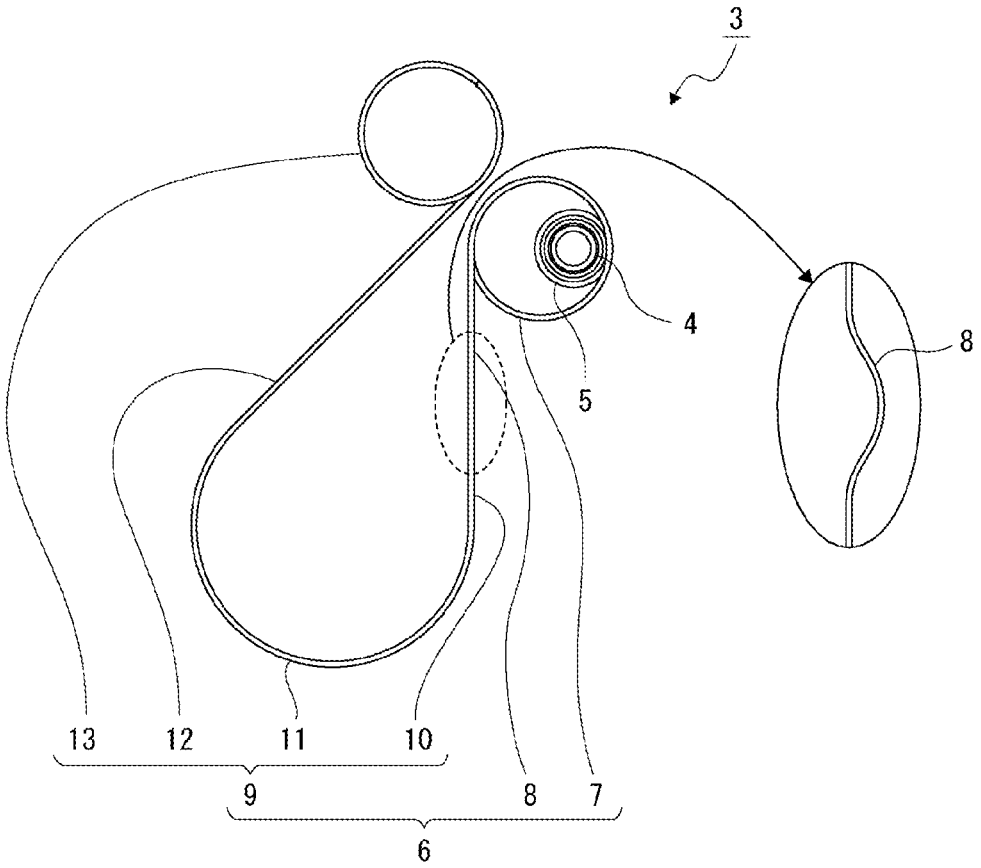
FIG. 4 is a side view of the sound collecting device.
Figure 5:
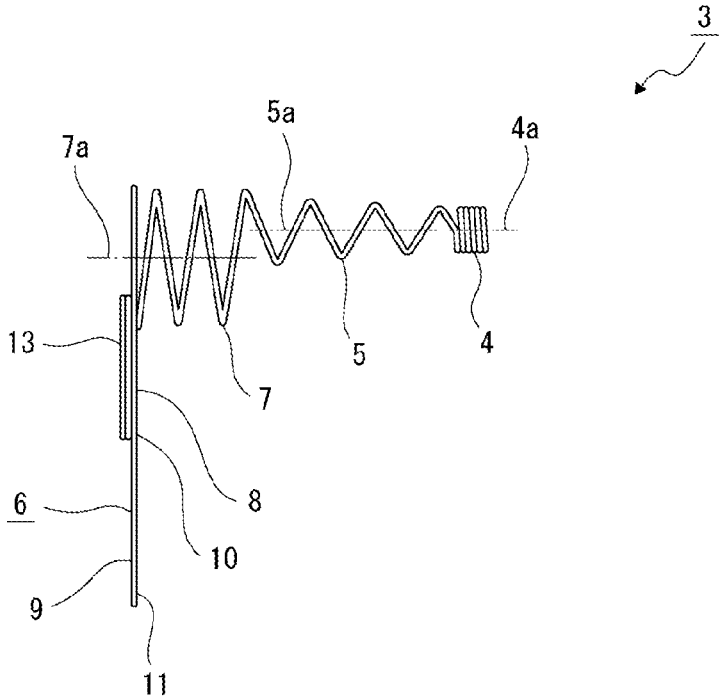
FIG. 5 is a front view of the sound collecting device.

Each sound collecting device 1 includes: a sound collecting unit 2 that collects sound; and a device main body 3 to which the sound collecting unit 2 is attached (see FIGS. 3 to 5).

The sound collecting unit 2 is, for example, a small microphone and has a sound input hole 2*a* to which sound is input. When the sound is input to the sound collecting unit 2 through the sound input hole 2*a*, binaural recording is performed, for example, and a head-related transfer function is measured on the basis of a recorded sound signal.

The device main body 3 includes an attachment portion 4, a holding portion 5, and a wearing portion 6, and each of the attachment portion 4, the holding portion 5, and the wearing portion 6 is formed in a predetermined shape by using, for example, a linear (wire-like) metal material. In the device main body 3, for example, the attachment portion 4, the holding portion 5, and the wearing portion 6 are integrally formed. Each of the attachment portion 4, the holding portion 5, and the wearing portion 6 has a cross-sectional shape formed by using, for example, a metal material having a circular shape. However, note that the cross-sectional shape of each of the attachment portion 4, the holding portion 5, and the wearing portion 6 is not limited to the circular shape, and it is desirable that an outer shape of the cross-sectional shape be formed in a curved shape, for example, in a circular shape, an elliptical shape, an elongated hole shape, or the like in a viewpoint of preventing scratch at the time of contacting the ear 100.

Since the device main body 3 is thus formed by using the metal material, high durability can be ensured. However, note that the device main body 3 may also be formed by using a material other than the metal material such as a resin material or the like as far as the high durability can be ensured. For example, a surface of the metal material such as a wire may be coated with a resin.

Furthermore, since the attachment portion 4, the holding portion 5, and the wearing portion 6 are integrally formed as described above, work of joining the attachment portion 4 and the holding portion 5 is not necessary, and also work of joining the holding portion 5 and the wearing portion 6 is not necessary, and therefore, the number of components and a manufacturing cost of the sound collecting device 1 can be reduced. However, note that the attachment portion 4 and the holding portion 5 may be integrally formed and the holding portion 5 and the wearing portion 6 may be separately formed, or the attachment portion 4 and the holding portion 5 may be formed separately and the holding portion 5 and the wearing portion 6 may be integrally in the sound collecting device 1. Furthermore, each of the attachment portion 4, the holding portion 5, and the wearing portion 6 may be formed separately.

The attachment portion 4 is formed in a coil shape and has an outer shape having the same size in an axial direction, and for example, has no interspace in the axial direction. The attachment portion 4 has a function of attaching the sound collecting unit 2, and the attachment portion is inserted into the deep side of the external ear canal 113 together with the sound collecting unit 2, and positioned near the eardrum 116 (see FIG. 6). The sound collecting unit 2 is attached to the inside of the attachment portion 4 (see FIGS. 3 to 5). The sound collecting unit 2 may be attached to the attachment portion 4 by, for example, bonding or press-fitting, and furthermore, the sound collecting unit 2 may be detachable from the attachment portion 4.

Since the sound collecting unit 2 is detachable from the attachment portion 4, the sound collecting unit 2 is replaceable with respect to the attachment portion 4, and therefore, it is possible to constantly keep the sound collecting unit 2 clean, and also maintainability of the sound collecting unit 2 can be improved. Furthermore, since the sound collecting unit 2 is detachable from the attachment portion 4, it is possible to use a type of the sound collecting unit 2 in accordance with a use.

The holding portion 5 is formed in a coil shape having an outer diameter larger than an outer diameter of the attachment portion 4, and is provided continuously to one end of the attachment portion 4. A center axis 5*a* of the holding portion 5 and a center axis 4*a* of the attachment portion 4 coincide with each other. However, note that the center axis 5*a* of the holding portion 5 and the center axis 4*a* of the attachment portion 4 do not necessarily coincide with each other, and it is sufficient that the attachment portion 4 is positioned on a more inner side than the holding portion 5 with respect to the external ear canal 113. The holding portion 5 has interspaces in the axial direction, and has a shape in which the outer shape becomes gradually smaller as a position of the holding portion approaches the attachment portion 4. The holding portion 5 has a function of holding the attachment portion 4 and the sound collecting unit 2 attached to the attachment portion 4, and is inserted into the external ear canal 113 together with the attachment portion 4 (see FIG. 6).

The holding portion 5 is elastically deformable in a direction in which the center axis 5*a* is bent. Accordingly, the holding portion 5 can be inserted into the external ear canal 113 while being slid and deformed on the wall surface 113*b* forming the external ear canal 113 (see FIG. 7), and the attachment portion 4 and the holding portion 5 can be thus smoothly and easily inserted into the external ear canal 113.

Furthermore, the holding portion 5 is formed in a shape in which the outer shape becomes gradually smaller as a position of the holding portion approaches the attachment portion 4 as described above. Accordingly, when the attachment portion 4 and the holding portion 5 are inserted into the external ear canal 113, the holding portion 5 is inserted from a side having the smaller outer shape, and therefore, the attachment portion 4 and the holding portion 5 can be smoothly and easily inserted into the external ear canal 113.

Moreover, the holding portion 5 is formed in the shape in which the outer shape becomes gradually smaller as a position of the holding portion approaches the attachment portion 4, but since the holding portion 5 is not formed in a shape having a sharp tip, a user is unlikely to have a feeling of fear or the like at the time of inserting the holding portion 5 into the external ear canal 113, and a psychological burden of a user can be suppressed.

Still furthermore, since the outer diameter of the attachment portion 4 that holds the sound collecting unit 2 is smaller than the outer diameter of the holding portion 5, the attachment portion 4 is easily held in midair in the external ear canal 113, the attachment portion 4 hardly contacts the wall surface 113*b* forming the external ear canal 113, and the head-related transfer function obtained from sound input to the external ear canal 113 by the sound collecting unit 2 can be accurately measured.

Furthermore, since the sound collecting unit 2 is attached to the inside of the attachment portion 4 in a state in which the attachment portion 4 and the holding portion 5 are inserted into the external ear canal 113, the sound collecting unit 2 is held in midair in the external ear canal 113.

Accordingly, since the sound collecting unit 2 does not contact the wall surface 113*b* forming the external ear canal 113, the head-related transfer function obtained from the sound input to the external ear canal 113 by the sound collecting unit 2 can be more accurately measured.

Moreover, in the state in which the attachment portion 4 and the holding portion 5 are inserted into the external ear canal 113, the sound collecting unit 2 is positioned in a state in which the sound input hole 2*a* is opened to the external acoustic foramen 113*a* side of the external ear canal 113.

Accordingly, since the sound input to the external ear canal 113 is surely and smoothly input to the sound collecting unit 2, the head-related transfer function obtained from the sound input to the external ear canal 113 can be measured more accurately.

In addition, since the sound input hole 2*a* of the sound collecting unit 2 is positioned on the eardrum 116 side with respect to the external acoustic foramen 113*a* of the external ear canal 113, the sound input to the external ear canal 113 is surely input to the sound collecting unit 2, and therefore, the head-related transfer function obtained from the sound input to the external ear canal 113 can be measured more accurately.

The wearing portion 6 includes an inner engagement portion 7, a middle portion 8, and an outer engagement portion 9 which are sequentially and continuously formed (see FIGS. 3 to 5).

The inner engagement portion 7 is formed in a coil shape having an outer diameter larger than the outer diameter of the holding portion 5, and is provided continuously to one end of the holding portion 5. The inner engagement portion 7 has an outer shape having the same size in an axial direction, and a center axis 7*a* is positioned biased in a direction axially orthogonal to the center axis 5*a* of the wearing portion 6 and the center axis 4*a* of the holding portion 5. The wearing portion 6 has interspaces in the axial direction.

The inner engagement portion 7 is a portion to be partly engaged with and worn on the auricle 101, and has the outer diameter larger than a diameter of the external acoustic foramen 113*a* of the external ear canal 113. The inner engagement portion 7 is elastically deformable in the axial direction that is a direction in which the inner engagement portion 7 contacts and separates from the holding portion 5.

Figure 6:
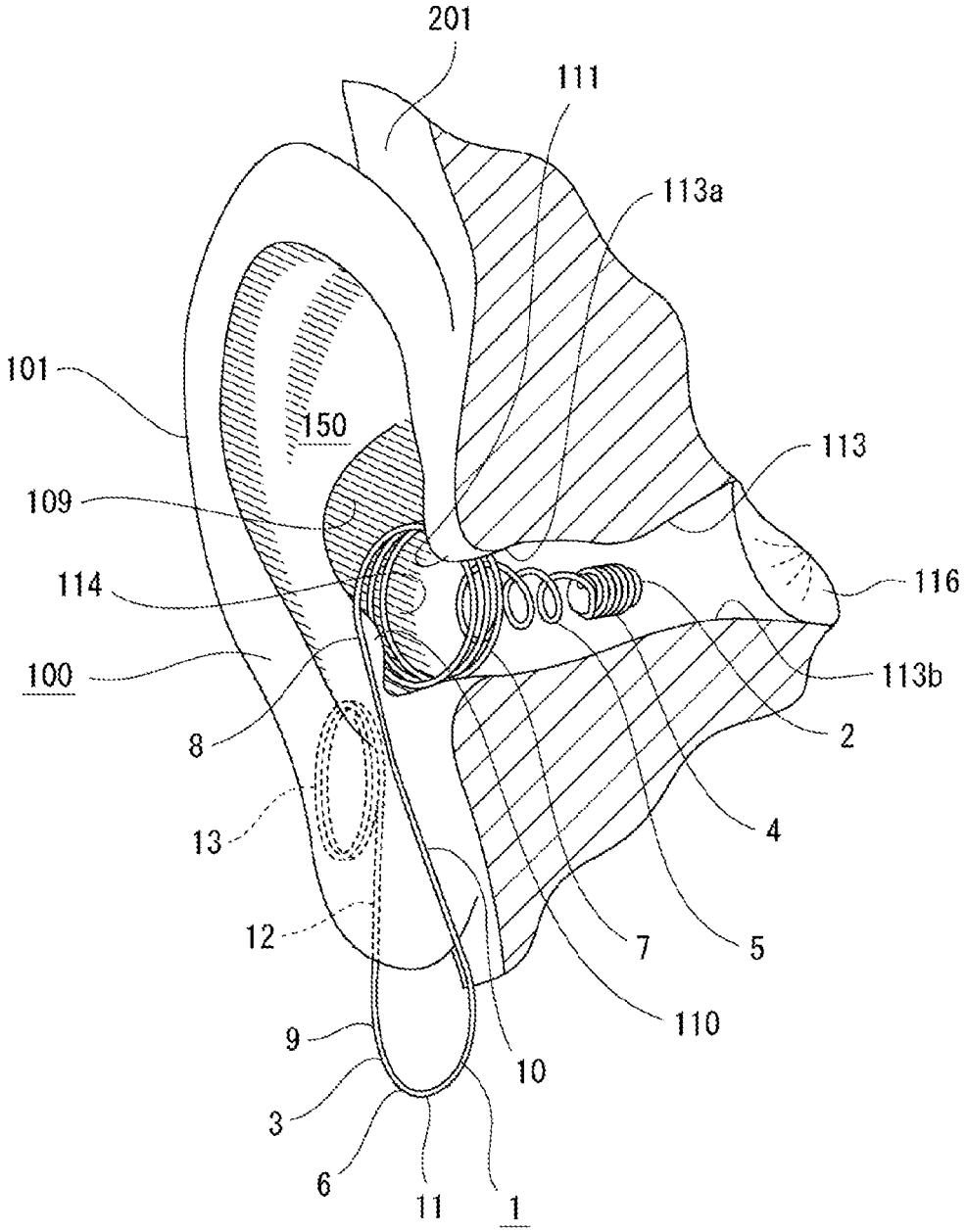
FIG. 6 is a perspective view partly illustrating a cross-section of the sound collecting device in a state being worn on the ear.
Figure 7:
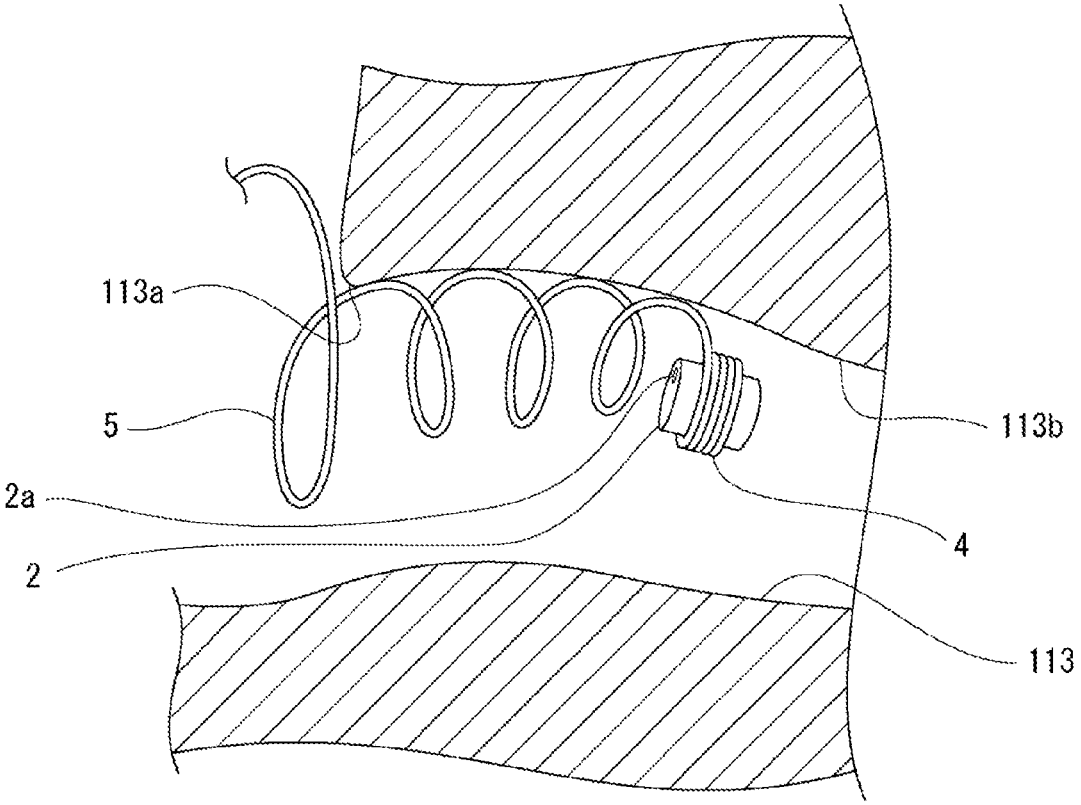
FIG. 7 is a view illustrating a state in which the sound collecting device is in a process of being inserted into an external ear canal.
Figure 8:
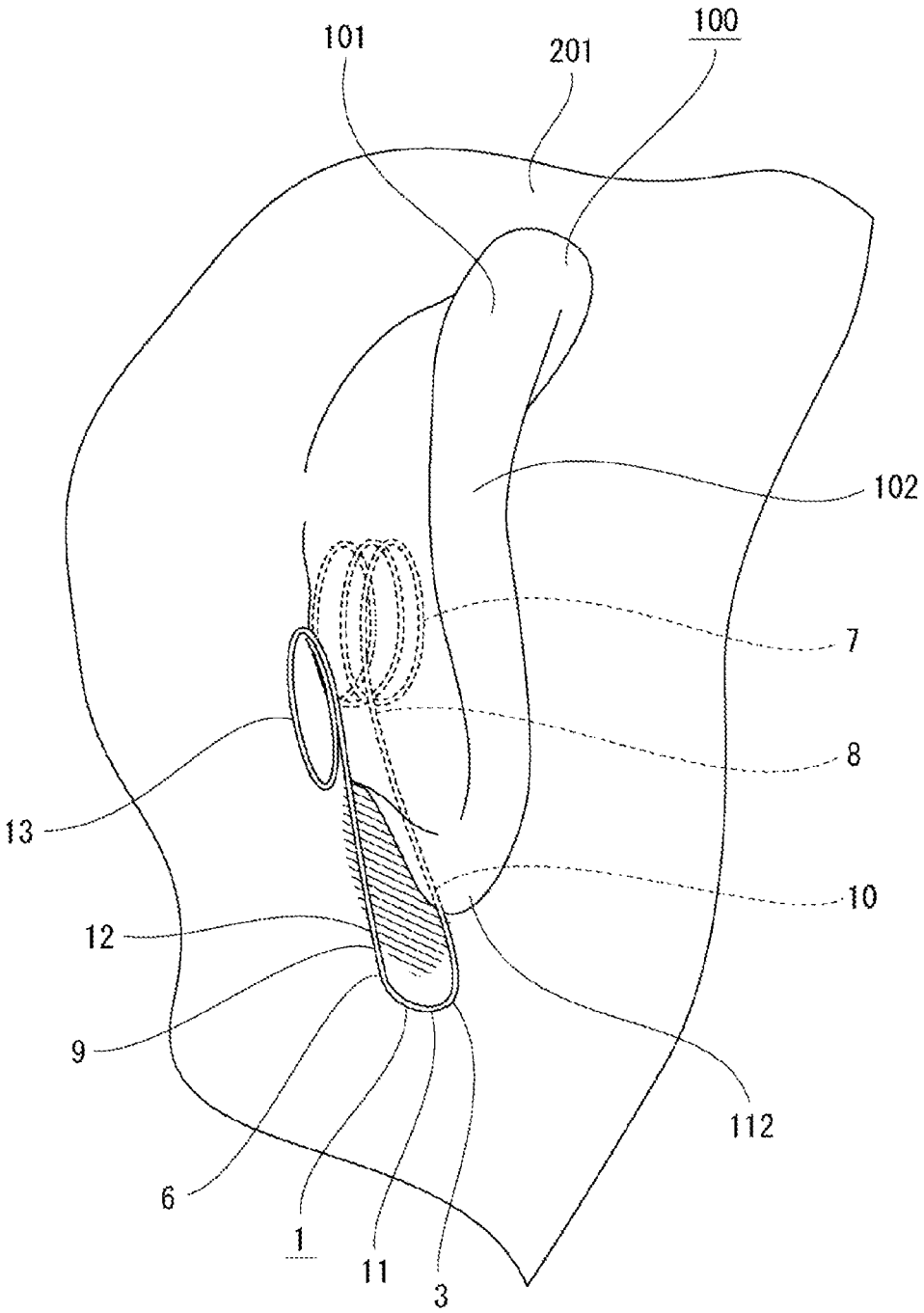
FIG. 8 is a view illustrating a state in which the sound collecting device is worn on an ear.
Figure 9:
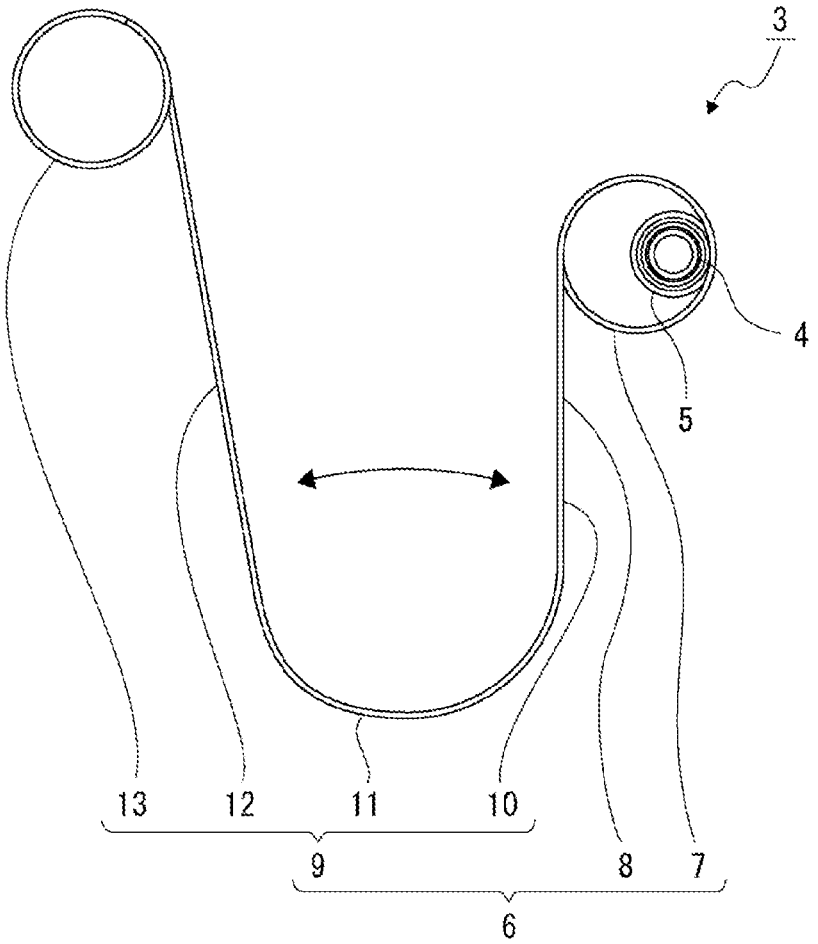
FIG. 9 is a side view illustrating a state in which the sound collecting device is partly elastically deformed before being worn on an ear.

The inner engagement portion 7 is inserted into the cavum conchae 114 in the state in which the sound collecting unit 2, the attachment portion 4, and the holding portion 5 are inserted into the external ear canal 113 (see FIG. 6). The inner engagement portion 7 is in a state in which an end surface on the attachment portion 4 side in the axial direction is made to contact a surface on the deep side forming the cavum conchae 114, and each portion of the inner engagement portion 7 on a surface opposite to the attachment portion 4 is elastically pressed against the tragus 111 or the antitragus 110 from the external ear canal 113 side in a state slightly compressed in the axial direction.

Thus, the inner engagement portion 7 is elastically deformable in the direction of contacting and separating from the holding portion 5 and positioned in the cavum conchae 114.

Accordingly, since each portion of the inner engagement portion 7 is pressed against the tragus 111 or the antitragus 110 from the external ear canal 113 side and positioned in the cavum conchae 114 as described above, the inner engagement portion 7 is engaged with and worn on the auricle 101 in a stable state, and it is possible to stabilize the position of the sound collecting unit 2 with respect to the external ear canal 113.

Furthermore, since the center axis 7*a* of the inner engagement portion 7 is biased in the direction axially orthogonal to the center axis 5*a* of the holding portion 5 and the center axis 4*a* of the attachment portion 4, the attachment portion 4, the holding portion 5, and the inner engagement portion 7 are made to have a positional relation corresponding to relative positions of the external ear canal 113 and the cavum conchae 114.

Accordingly, the attachment portion 4 and the holding portion 5 can be smoothly and easily inserted into the external ear canal 113, and the inner engagement portion 7 is smoothly and easily inserted into the cavum conchae 114 and can be worn on the auricle 101.

Moreover, since the outer diameter of the inner engagement portion 7 is made larger than the diameter of the external acoustic foramen 113*a* of the external ear canal 113, the inner engagement portion 7 is not inserted into the external ear canal 113, the stable wearing state of the sound collecting device 1 with respect to the ear 100 can be ensured, and also the position of the sound collecting unit 2 with respect to the external ear canal 113 can be stabilized.

The middle portion 8 is formed in a straight shape and provided continuously to one end of the inner engagement portion 7. The middle portion 8 is led to the front side of the auricle 101 from the incisura intertragica 115 and positioned on the front side of a lower-end-side portion of the auricle 101 in the state in which the inner engagement portion 7 is positioned at the cavum conchae 114. The middle portion 8 is formed in the straight shape that is slightly inclined in a vertical direction, and an upper end portion is positioned closer to the temporal region 201 than a lower end portion in a state in which the inner engagement portion 7 is inserted into the cavum conchae 114. Since the middle portion 8 is thus led from the incisura intertragica 115 and positioned on the front side of the lower-end-side portion of the auricle 101, the upper end portion is formed in the straight shape inclined in the direction closer to the temporal region 201 than the lower end portion as described above, and therefore, the middle portion hardly interferes with the lower-end-side portion of the auricle 101, the positions of the inner engagement portion 7 and the holding portion 5 are hardly changed, and the position of the sound collecting unit 2 with respect to the external ear canal 113 can be stabilized.

Note that the middle portion 8 may also be formed in a linear shape bent in a mountain shape that projects substantially frontward (see a circled portion in FIG. 4). Since the middle portion 8 is formed in the linear shape bent in the mountain shape, the middle portion 8 also hardly interferes with the lower-end-side portion of the auricle 101, the positions of the inner engagement portion 7 and the holding portion 5 are hardly changed, and the position of the sound collecting unit 2 with respect to the external ear canal 113 can be stabilized.

The outer engagement portion 9 is continuously provided at one end of the middle portion 8 (see FIGS. 3 to 5). The outer engagement portion 9 includes a first acting portion 10 continuous to the middle portion 8, an intermediate coupling portion 11 continuous to the first acting portion 10, a second acting portion 12 continuous to the intermediate coupling portion 11, and a terminal end portion 13 continuous to the second acting portion 12.

The first acting portion 10 is formed in a straight shape extending substantially in the vertical direction. The intermediate coupling portion 11 is positioned at the lowermost position of the outer engagement portion 9, and is formed in an arc shape having an axial direction substantially in a horizontal direction. The second acting portion 12 is positioned behind the middle portion 8 and the first acting portion 10, and is formed in a straight shape that comes close to the middle portion 8 as a position becomes higher. An upper end portion of the second acting portion 12 is positioned closest to the continuous portion between the inner engagement portion 7 and the middle portion 8. The terminal end portion 13 is formed in a circular shape having an axial direction substantially in the horizontal direction.

In a state in which the inner engagement portion 7 is positioned in the cavum conchae 114, the outer engagement portion 9 has the first acting portion 10 positioned at a lower front side of the auricle 101, has the intermediate coupling portion 11 positioned from the front to the back at a lower side of the auricle 101, and has the second acting portion 12 and the terminal end portion 13 positioned on the back side of the auricle 101 (see FIG. 6). At this time, the outer engagement portion 9 has the upper end portion of the second acting portion 12 engaged with a root portion on a back surface of the auricle 101 (see FIG. 8).

As described above, the sound collecting device 1 is worn on the ear 100 by engaging the inner engagement portion 7 with a part of the auricle 101 and engaging the second acting portion 12 with the root portion on the back surface of the auricle 101, and therefore, the sound collecting device 1 can be easily worn on the ear 100 in the stable state.

Furthermore, the outer engagement portion 9 is elastically deformable in the direction in which the first acting portion 10 and the second acting portion 12 contact and separate from each other. Accordingly, the outer engagement portion 9 is made to an opened state by elastically deforming the first acting portion 10 and the second acting portion 12 so as to separate from each other when the sound collecting device 1 is worn on the ear 100 (see FIG. 9), and the sound collecting device 1 can be easily worn on the ear 100 by inserting the auricle 101 between the first acting portion 10 and the second acting portion 12 of the outer engagement portion 9 in the open state. Moreover, since the sound collecting device 1 is worn on the auricle 101 in the state in which the second acting portion 12 is elastically pressed against the back surface of the auricle 101, the sound collecting device 1 hardly falls off from the ear 100, and it is possible to ensure an easy and stable wearing state of the sound collecting device 1 on the ear 100.

BRIEF SUMMARY

As described above, the sound collecting device 1 includes: the attachment portion 4 that has the sound collecting unit 2 attached and is adapted to be inserted into the external ear canal 113; the holding portion 5 adapted to be inserted into the external ear canal 113 and hold the attachment portion 4 at the predetermined position in the external ear canal 113; and the wearing portion 6 that is positioned on the opposite side of the attachment portion 4 while interposing the holding portion 5 and adapted to be at least partly engaged with the auricle 101, and the attachment portion 4 and the holding portion 5 do not block the external ear canal 113 and have acoustic transparency.

Accordingly, the attachment portion 4 that has the sound collecting unit 2 attached and is adapted to be inserted into the external ear canal 113, and the holding portion 5 adapted to hold the attachment portion 4 at the predetermined position in the external ear canal 113 are positioned in the state of not blocking the external ear canal 113 with respect to the ear 100, and therefore, propagation of sound waves toward the sound collecting unit 2 is hardly hindered, and it is possible to provide the sound collecting device 1 in which sound is favorably input to the sound collecting unit 2.

In particular, since the second acting portion 12 is engaged with the back surface of the auricle 101 and the inner engagement portion 7 is held in a state of being engaged with the cavum conchae 114, the sound collecting device 1 hardly slips off from the ear 100 and it is possible to ensure the stable wearing state of the sound collecting device 1 with respect to the ear 100.

Furthermore, since the inner engagement portion 7 continuous to the attachment portion 4 and the holding portion 5 each having a constant length is held in the cavum conchae 114, even in a case where the sound collecting device 1 is repeatedly worn on the ear 100, the position of the sound collecting unit 2 held by the attachment portion 4 with respect to the eardrum 116 is always constant, and it is possible to ensure high reproducibility of the position of the sound collecting unit 2 with respect to the eardrum 116, and reliability of a measured value can be improved. Note that the sound collecting device 1 is worn on each of both the left ear 100 and the right ear 100, but the positions of the sound collecting units 2 and 2 with respect to the eardrums 116 and 116 can be always made constant in the left and right ears 100 and 100 as well.

Furthermore, since the attachment portion 4 and the holding portion 5 have the length such that the attachment portion 4 and the sound collecting unit 2 do not contact the eardrum 116 at the time of being insertion into the external ear canal 113, the attachment portion 4 and the sound collecting unit 2 are prevented from contacting the eardrum 116, and the eardrum 116 can be protected.

Still furthermore, since all of the attachment portion 4, the holding portion 5, and the wearing portion 6 are formed in the predetermined shapes by using the linear materials, the attachment portion 4, the holding portion 5, and the wearing portion 6 each have a small thickness and a small volume. Therefore, sound waves are hardly reflected or diffracted by the attachment portion 4, the holding portion 5, and the wearing portion 6, and it is possible to ensure a favorable sound input state to the sound collecting unit 2.

In addition, since all of the attachment portion 4, the holding portion 5, and the inner engagement portion 7 are formed in the coil shapes, the attachment portion 4, the holding portion 5, and the inner engagement portion 7 each have the small volume, the reflection or diffraction of the sound waver are more hardly caused by the attachment portion 4, the holding portion 5, and the inner engagement portion 7, and it is possible to ensure a more favorable sound input state to the sound collecting unit 2.

In particular, the attachment portion 4 and the holding portion 5, which are to be inserted into the external ear canal 113, are each formed in the coil shape, and the outer peripheral surface of the cross-sectional shape thereof is formed in the curved shape. Therefore, even in a case where the attachment portion 4 and the holding portion 5 contact the wall surface 113*b* of the external ear canal 113, it is also possible to prevent the wall surface 113*b* from being scratched.

Modified Examples, Etc. of Respective Units

Modified examples, etc. of the respective units of the sound collecting device 1 will be described below.

[Attachment Portion]

First, a modified example of the attachment portion 4 will be described (see FIGS. 10 to 13).

Figure 10:
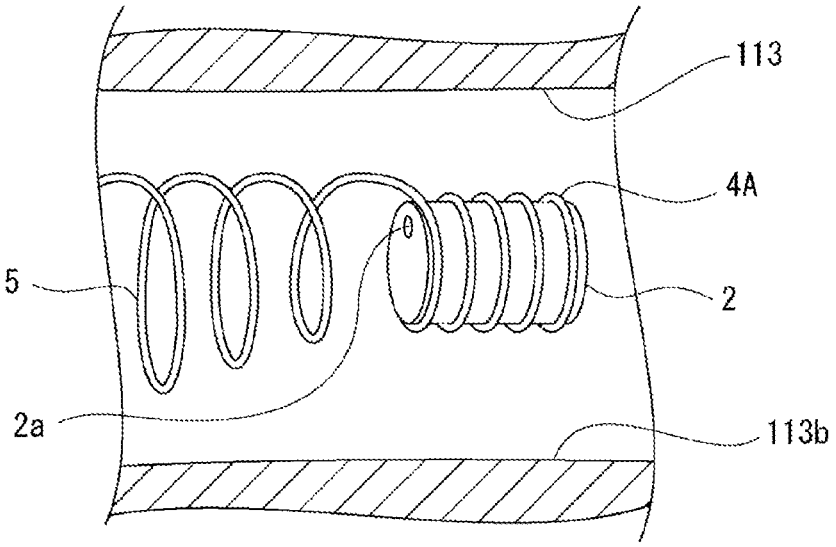
FIG. 10 illustrates, together with FIGS. 11 to 35, modified examples, etc. of respective portions of the sound collecting device, and the present drawing is a view illustrating a first modified example of an attachment portion.

An attachment portion 4A according to a first modified example is formed in a coil shape in a state in which interspaces are provided between respective portions in the axial direction, and is wound around the sound collecting unit 2 (see FIG. 10). The sound collecting unit 2 is held by winding the attachment portion 4A around the sound collecting unit 2, and the sound collecting unit 2 is replaceable with respect to the attachment portion 4A. Since the sound collecting unit 2 can be held by winding the attachment portion 4A therearound, the sound collecting unit 2 can be easily held.

In this case, a spiral groove may be formed on an outer peripheral surface of the sound collecting unit 2, and the attachment portion 4A may be wound along the spiral groove. Since the groove is formed on the outer peripheral surface of the sound collecting unit 2 and the attachment portion 4A is wounded along the groove, the sound collecting unit 2 can be prevented from falling off from the attachment portion 4A and the sound collecting unit 2 can also be easily held by the attachment portion 4A.

Figure 11:
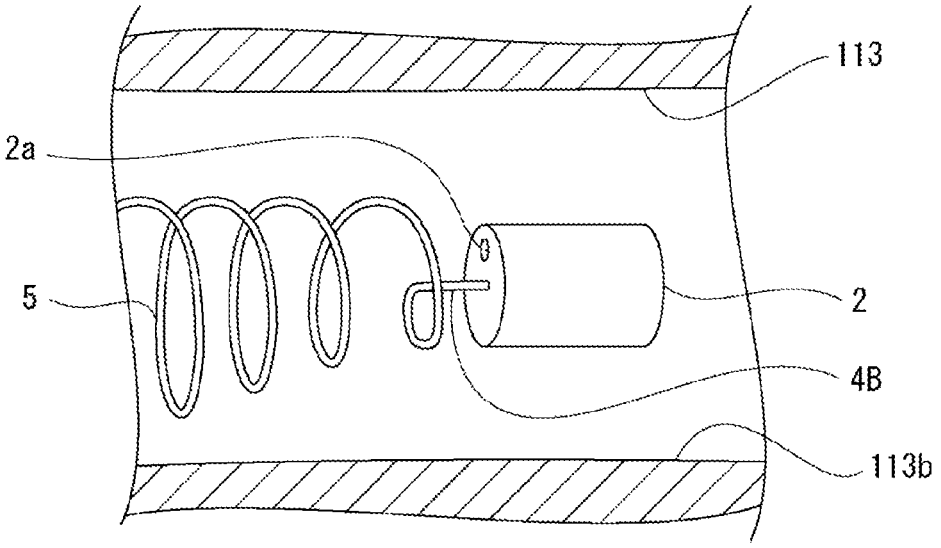
FIG. 11 is a view illustrating a second modified example of the attachment portion.

An attachment portion 4B according to a second modified example is formed in a straight shape and is fixed to a part of the sound collecting unit 2 by, for example, bonding (see FIG. 11). Since the attachment portion 4B is formed in the straight shape, weight thereof is reduced, and therefore, the sound collecting device 1 is reduced in weight, and when the sound collecting device 1 is worn on the ear 100, a load on the ear 100 is small and a favorable wearing feeling is ensured.

Figure 12:
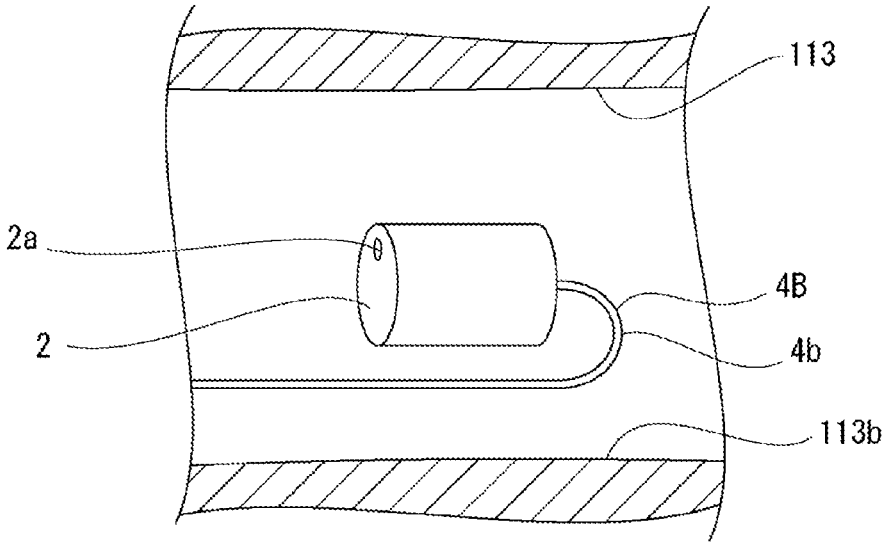
FIG. 12 is a view illustrating an example in the second modified example of the attachment portion, in which the attachment portion is fixed to a surface opposite to a surface of the sound collecting unit where a sound input hole is formed.

Furthermore, the attachment portion 4B may be fixed to a surface opposite to a surface of the sound collecting unit 2 where the sound input hole 2*a* is formed in a state in which the sound input hole 2*a* of the sound collecting unit 2 faces the external acoustic foramen 113*a* (see FIG. 12). Since the attachment portion 4B is thus fixed to the surface opposite to the surface of the sound collecting unit 2 where the sound input hole 2*a* is formed, a favorable sound input state to the sound collecting unit 2 can be ensured without blocking the sound input hole 2*a* with the attachment portion 4B.

Note that, in the case where the attachment portion 4B is fixed to the surface opposite to the surface of the sound collecting unit 2 where the sound input hole 2*a* is formed, the attachment portion 4B is partly bent in a manner folded back, and a bent portion 4*b* is desirably bent in a curved shape, for example, a semicircular shape. Since the bent portion 4*b* of the attachment portion 4B is bent in the curved shape, the wall surface 113*b* of the external ear canal 113 can be protected. Furthermore, the wall surface 113*b* may also be protected by attaching a cushion material to the bent portion 4*b* to prevent contact between the wall surface 113*b* of the external ear canal 113 and the bent portion 4*b*.

Figure 13:
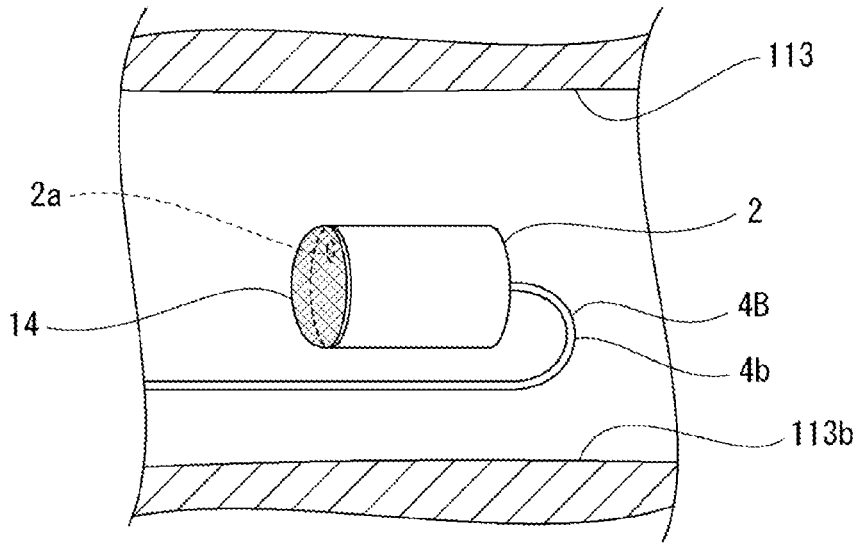
FIG. 13 is a view illustrating an example in the second modified example of the attachment portion, in which a filter is attached to the attachment portion.

Moreover, a filter 14 may be attached to the surface of the sound collecting unit 2 where the sound input hole 2*a* is formed (see FIG. 13). Since the filter 14 is attached to the surface of the sound collecting unit 2 where the sound input hole 2*a* is formed, a foreign matter such as earwax is prevented from entering the sound collecting unit 2 from the sound input hole 2*a*, and accurate measurement results can be obtained.

Note that the configuration in which the filter 14 is attached to the sound collecting unit 2 can also be used in a configuration in which the sound collecting unit 2 is protected by the attachment portions 4 and 4A.

[Holding Portion]

Next, a modified example of the holding portion 5 will be described (see FIGS. 14 to 22).

Figure 14:
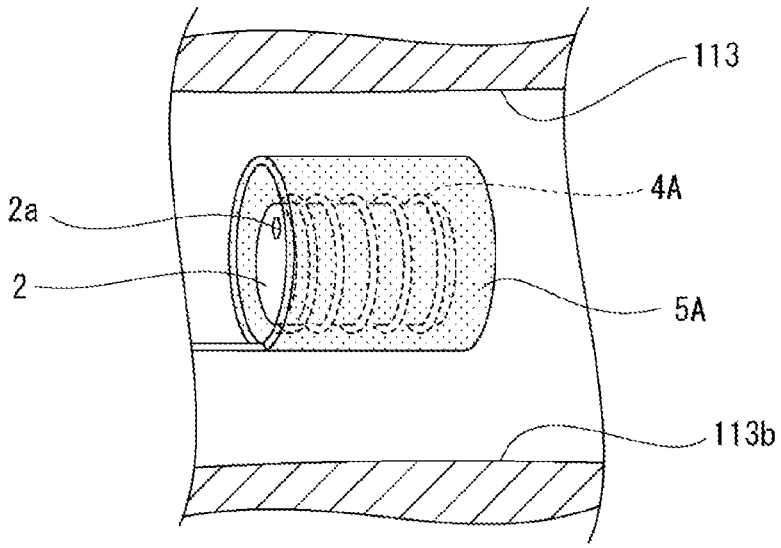
FIG. 14 is a view illustrating a first modified example of a holding portion.

The holding portion 5A according to the first modified example has a mesh-like form and is formed in a tubular shape, for example, a cylindrical shape (see FIG. 14). The holding portion 5A has a deeper-side end portion continuous to the attachment portion 4A, and the attachment portion 4A is positioned, for example, inside the holding portion 5A. Such a mesh-like form can be formed by using, for example, a resin material such as polypropylene or polyethylene, or a thin metal material. Furthermore, the holding portion 5A may also be formed by using a shape memory alloy.

Since the mesh-like holding portion 5A is used, sound waves are hardly reflected or diffracted by the holding portion 5A, and a favorable sound input state to the sound collecting unit 2 can be ensured. Furthermore, since the attachment portion 4A is positioned inside the tubular holding portion 5A, the sound collecting unit 2 is held in midair in the external ear canal 113, and a head-related transfer function obtained from sound input to the external ear canal 113 by the sound collecting unit 2 can be accurately measured.

Figure 15:
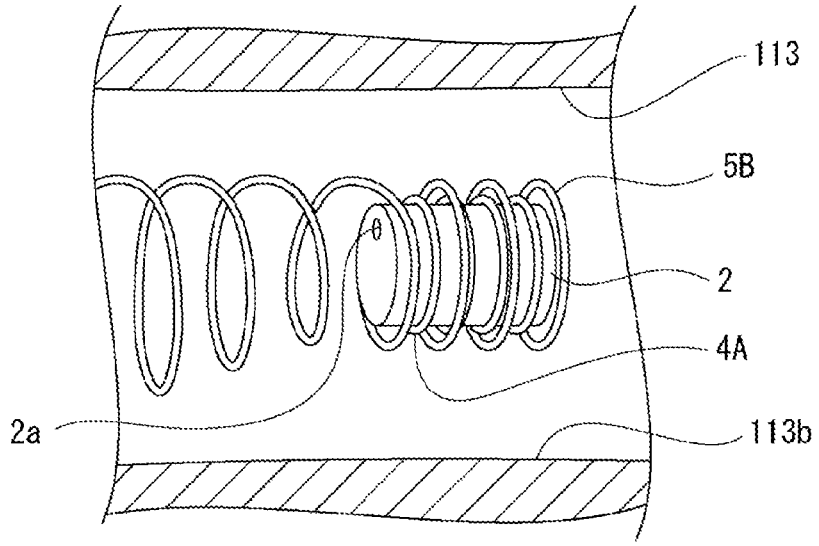
FIG. 15 is a view illustrating a second modified example of the holding portion.

The holding portion 5B according to a second modified example is formed in a coil shape and has the same diameter in the axial direction (see FIG. 15). The holding portion 5B has a deeper-side end portion continuous to the attachment portion 4A, and the attachment portion 4A is positioned inside the holding portion 5B. Note that the holding portion 5B illustrated in FIG. 15 has the same diameter in the axial direction, but the holding portion 5B does not necessarily have the same diameter, and for example, the holding portion 5B may have a shape in which the diameter becomes larger toward the external acoustic foramen 113*a*.

Since the attachment portion 4A is positioned inside the holding portion 5B, the sound collecting unit 2 is held in midair in the external ear canal 113, and the head-related transfer function obtained from sound input to the external ear canal 113 by the sound collecting unit 2 can be accurately measured.

Figure 16:
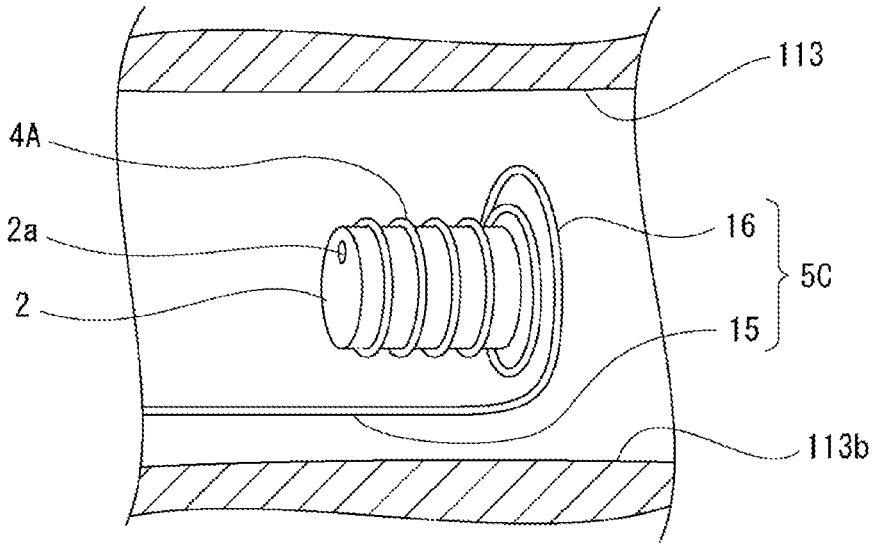
FIG. 16 is a view illustrating a third modified example of the holding portion.

A holding portion 5C according to a third modified example includes a straight portion 15 and an annular portion 16 continuous to a deeper-side end portion of the straight portion 15 (see FIG. 16). The annular portion 16 is formed in a circular shape, for example. The attachment portion 4A is continuous to the annular portion 16 of the holding portion 5C, and the annular portion 16 has an outer diameter larger than an outer diameter of the attachment portion 4A.

Since the annular portion 16 in the holding portion 5C has the outer diameter larger than the outer diameter of the attachment portion 4A, the sound collecting unit 2 is held in midair in the external ear canal 113, and the head-related transfer function obtained from sound input to the external ear canal 113 by the sound collecting unit 2 can be accurately measured. Furthermore, since the holding portion 5C includes the straight portion 15 and the annular portion 16 and has light weight, the sound collecting device 1 is reduced in weight, and a favorable wearing feeling is ensured when the sound collecting device 1 is worn on the ear 100.

Figure 17:
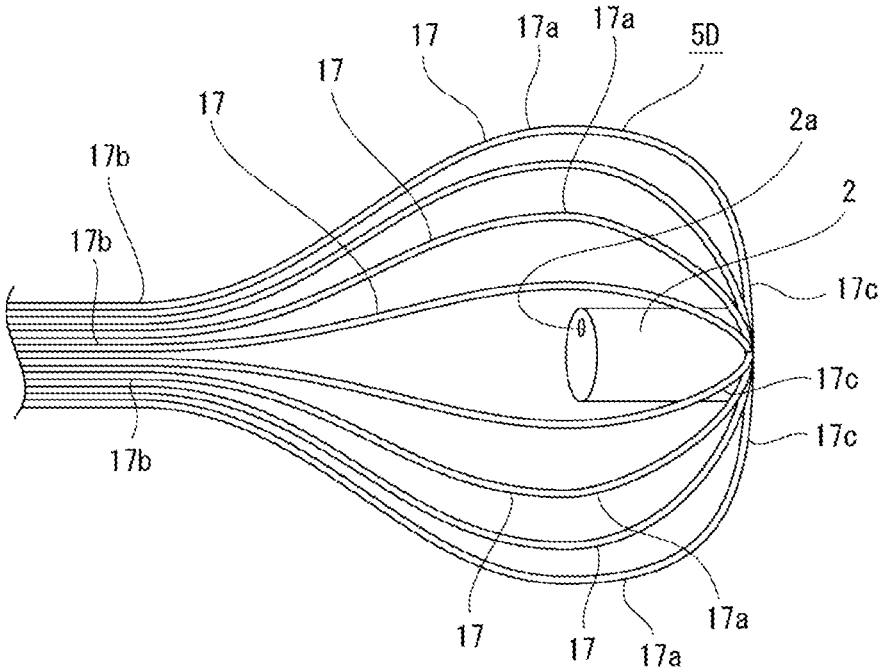
FIG. 17 is a view illustrating a fourth modified example of the holding portion in a state before the holding portion is inserted into the external ear canal.
Figure 18:
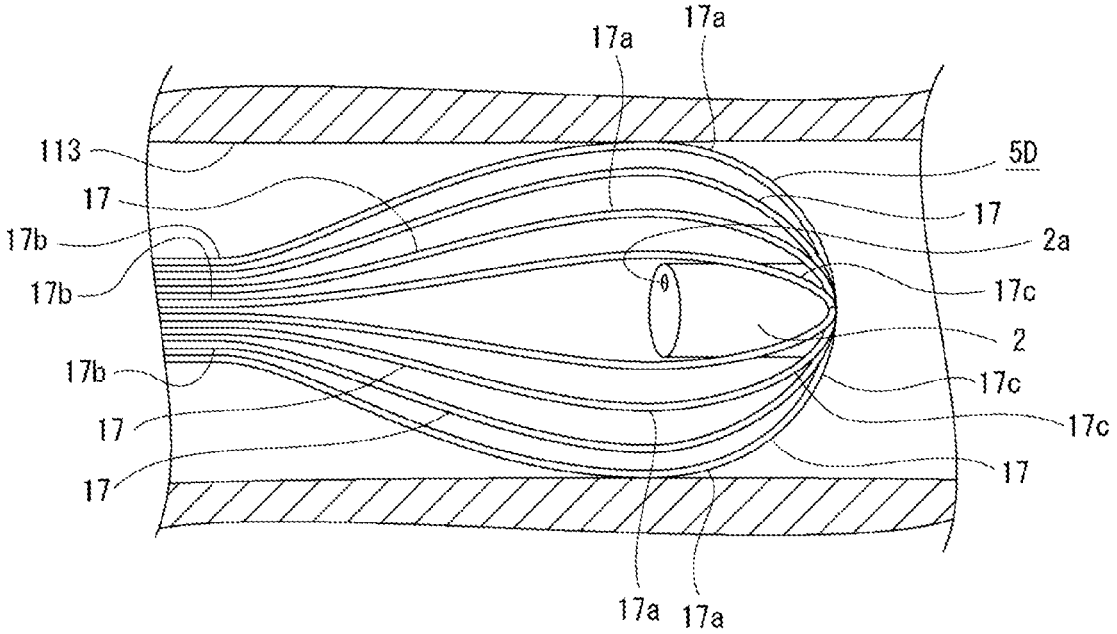
FIG. 18 is a view illustrating the fourth modified example of the holding portion in a state where the holding portion is inserted into the external ear canal.

A holding portion 5D according to a fourth modified example is formed by arraying a plurality of elastically deformable linear members 17, 17, . . . in a circumferential direction, for example, formed in a shape like a whisk or a tea whisk, and formed in a shape in which each middle portion 17*a* bulges outward and end portions 17*b* and 17*c* on both sides are narrowed (see FIGS. 17 and 18). The holding portion 5D has a deeper-side end portion 17*c* continuous to the attachment portion 4A, and the attachment portion 4A is positioned, for example, inside the holding portion 5D.

In a state before the holding portion 5D is inserted into the external ear canal 113, each middle portion 17*a* bulges outward in a maximum size (see FIG. 17). When the holding portion 5D is inserted into the external ear canal 113, each middle portion 17*a* is slid on the wall surface 113*b*, the middle portion 17*a* is elastically deformed into the narrowed state by force received from the wall surface 113*b*, and its entire length becomes slightly longer (see FIG. 18).

Since the holding portion 5D whose outer shape is thus changed is used, the sound collecting unit 2 can be surely inserted into the inside of the external ear canal 113 regardless of a size of the external ear canal 113 of each person because the holding portion 5D is inserted regardless of the size of the external ear canal 113. Furthermore, since the attachment portion 4A is positioned inside the holding portion 5D, the sound collecting unit 2 is held in midair in the external ear canal 113, and the head-related transfer function obtained from sound input to the external ear canal 113 by the sound collecting unit 2 can be accurately measured.

Figure 19:
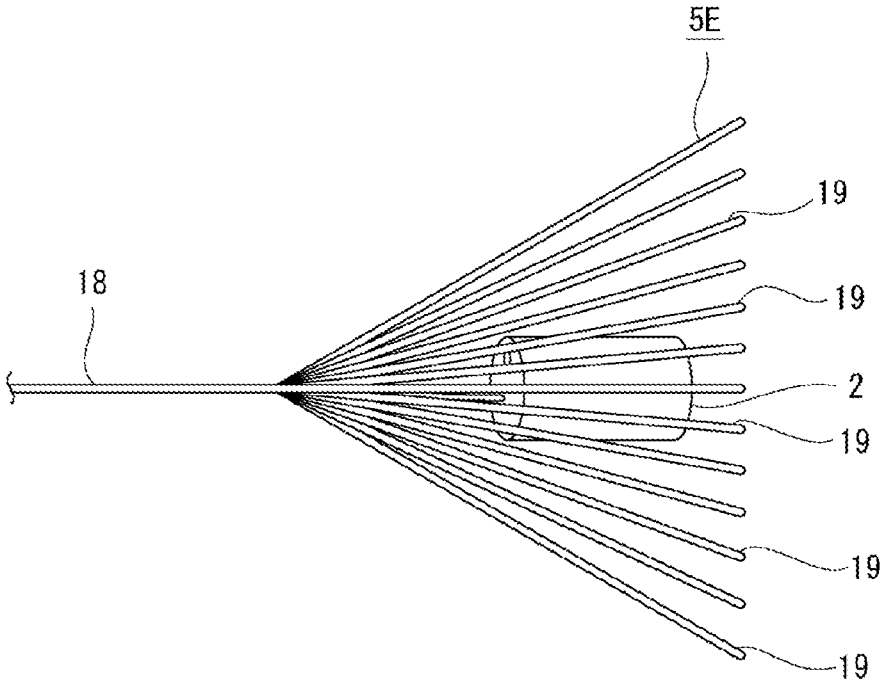
FIG. 19 is a view illustrating a fifth modified example of the holding portion in a state before the holding portion is inserted into the external ear canal.
Figure 20:
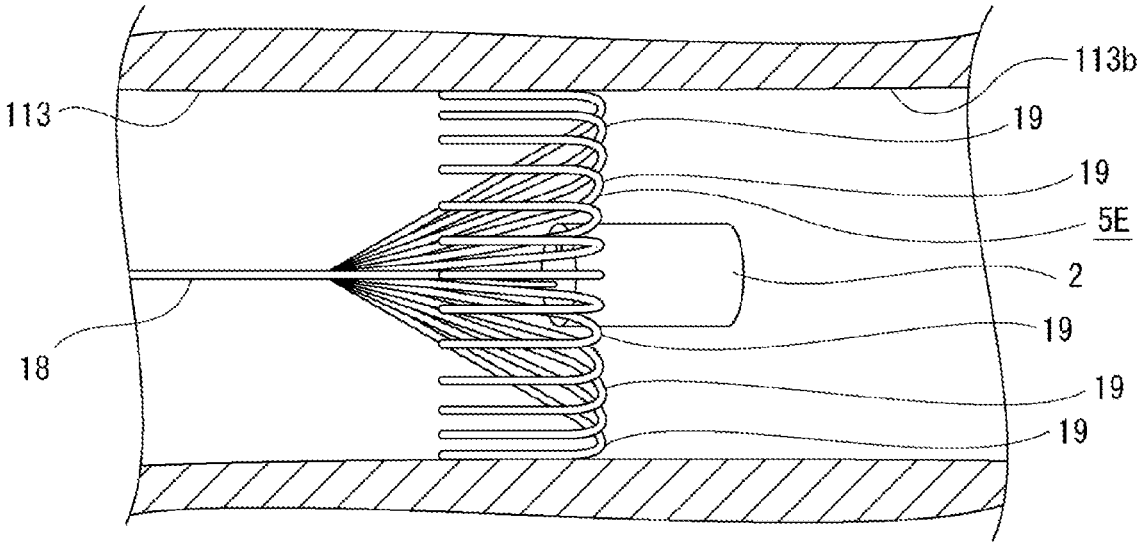
FIG. 20 is a view illustrating a fifth modified example of the holding portion in a state where the holding portion is inserted into the external ear canal.

A holding portion 5E according to a fifth modified example includes one first linear member 18 and a plurality of second linear members 19, 19, . . . , and respective end portions of the second linear members 19, 19, . . . are joined to a deeper-side end portion of the first linear member 18 (see FIGS. 19 and 20). The second linear members 19, 19, . . . are positioned so as to be displaced toward an outer peripheral side as the second linear members separate from the first linear member 18. The second linear members 19, 19, . . . are elastically deformable.

The attachment portion 4A is continuous to the deeper-side end portion of the first linear member 18, and the attachment portion 4A is positioned inside the second linear members 19, 19, . . . , for example.

In the state before the holding portion 5E is inserted into the external ear canal 113, the second linear members 19, 19, . . . are formed in straight shapes (see FIG. 19). When the holding portion 5E is inserted into the external ear canal 113, the second linear members 19, 19, . . . are slid on the wall surface 113*b*, the second linear members 19, 19, . . . are elastically deformed in a manner folded back outward by force received from the wall surface 113*b* (see FIG. 20). Note that each of tip portions of the second linear members 19, 19, . . . may be curved in a U shape instead of the straight shape. Therefore, a contacting feeling with skin can be softened when the holding portion 5E is inserted into the external ear canal 113.

Since the holding portion 5E having the outer shape thus changed is used, the holding portion 5E is inserted regardless of the size of the external ear canal 113, and therefore, the sound collecting unit 2 can be surely inserted into the inside of the external ear canal 113 regardless of the size of the external ear canal 113 of each person. Furthermore, since the attachment portion 4A is positioned inside the holding portion 5E, the sound collecting unit 2 is held in midair in the external ear canal 113, and the head-related transfer function obtained from sound input to the external ear canal 113 by the sound collecting unit 2 can be accurately measured.

Figure 21:
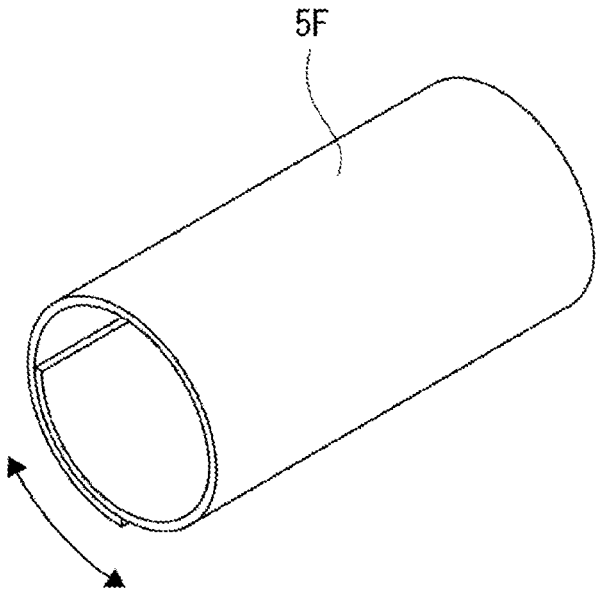
FIG. 21 is a view illustrating a sixth modified example of the holding portion.

A holding portion 5F according to a sixth modified example is formed by using a sheet-like material (see FIG. 21). In a description of the holding portion 5F, the attachment portion is not illustrated, but the holding portion 5F has a configuration utilizing force that increases a diameter of a sheet rolled up in a cylindrical shape when force that has rolled up the sheet is released. Accordingly, the holding portion 5F is inserted into the external ear canal 113 in a state of being rolled up to have the small diameter, and the diameter is increased in the state in which the holding portion 5F is inserted into the external ear canal 113 so as to be brought into a contact state with the wall surface 113*b*.

Figure 22:
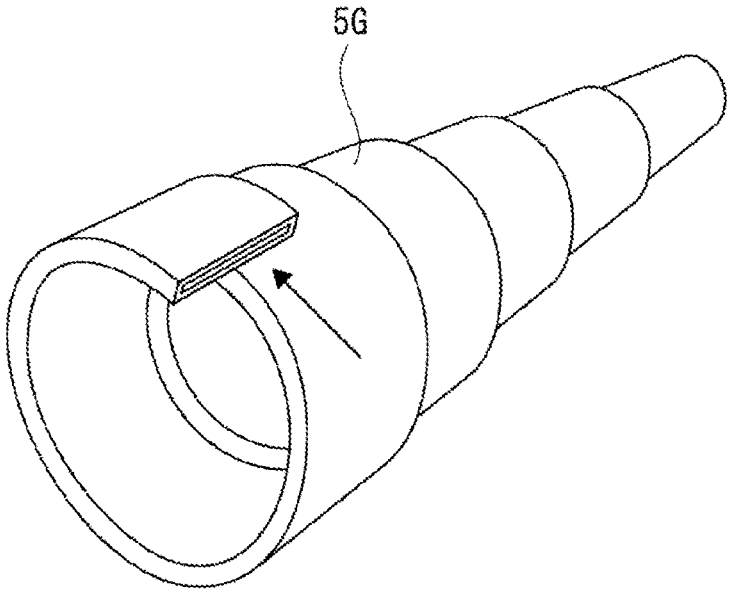
FIG. 22 is a view illustrating a seventh modified example of the holding portion.

A holding portion 5G according to a seventh modified example is formed by using a bag-shaped deformable material (see FIG. 22). In a description of the holding portion 5G, the attachment portion is not illustrated, but the holding portion 5G has a configuration utilizing force that deforms the bag-shaped member into a planar shape when the air is enclosed in the bag-shaped member that is at least partly formed in a spiral form. Accordingly, the holding portion 5G is inserted into the external ear canal 113 in the state of being rolled up to have a small diameter, and when the force that deforms the holding portion 5G into the planar shape is applied by enclosing the air inside thereof in the state of being inserted into the external ear canal 113, the holding portion 5G is developed toward the wall surface 113*b* of the external ear canal and the deeper side of the external ear canal 113.

Note that it is also possible to use, for example, a holding portion formed by using a thermally expandable material that can be expanded or contracted by heat, in addition to the holding portion of a type in which the size or the shape is deformed like the holding portions 5D, 5E, 5F, and 5G according to the fourth to seventh modified examples.

Furthermore, the holding portion may be formed in a band shape or a corrugated plate shape. In this case also, the holding portion may be elastically deformable.

Note that the above description has been provided for the examples of using the attachment portion 4A in each of the modified examples of the holding portion, but the attachment portion 4 or the attachment portion 4B may also be used instead of the attachment portion 4A in each of the modified examples of the holding portion.

[Inner Engagement Portion]

Next, a modified example of the inner engagement portion 7 will be described (see FIG. 23).

Figure 23:
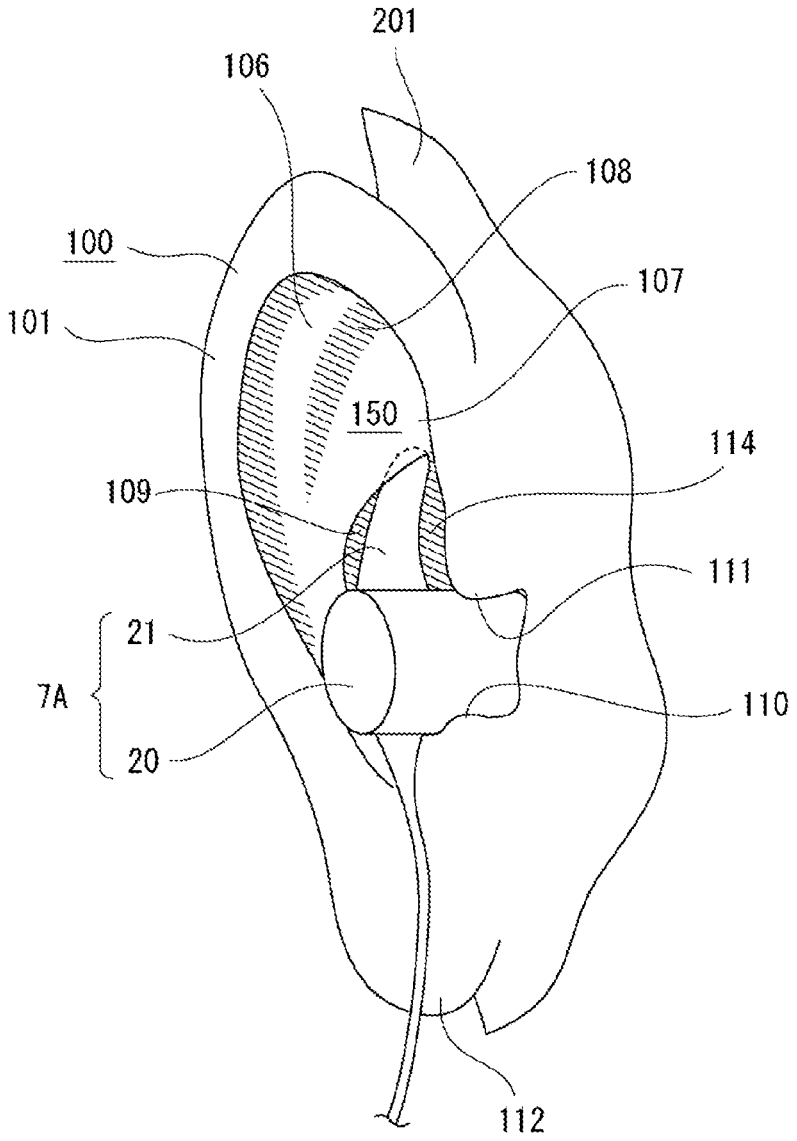
FIG. 23 is a view illustrating a modified example of an inner engagement portion.

An inner engagement portion 7A according to the modified example includes a main body 20 and a hook 21 (see FIG. 23). The main body 20 is not limited to a coil shape and may have another shape, for example, a cylinder shape or the like. The main body 20 is inserted into the cavum conchae 114. The hook 21 protrudes from an upper end portion of the main body 20, and is formed in, for example, a shaft shape having a straight shape or a curved shape. The hook 21 has a tip portion inserted into the cymba conchae 109 and the tip portion is engaged with a part of the auricle 101.

As described above, since the inner engagement portion 7 is engaged with the part of the auricle 101 by inserting the hook 21 into the cymba conchae 109 in the state in which the main body 20 is inserted into the cavum conchae 114, the sound collecting device 1 is prevented from being slipped off from the ear 100 in wearing the sound collecting device, and a stable wearing state of the sound collecting device 1 with respect to the ear 100 can be ensured.

Note that the inner engagement portion may be formed like a mesh-like form by using a resin material such as polypropylene or polyethylene or a thin metal material, in a manner similar to the holding portion 5A, or may also be formed by using a shape memory alloy. Furthermore, the inner engagement portion may be formed in a band shape or a corrugated plate shape in a manner similar to the holding portion, and in this case, the inner engagement portion may be elastically deformable.

Furthermore, the inner engagement portion can be selected in accordance with a shape and a size of the auricle 101 and shapes of folds of the auricle 101 of each person, and the inner engagement portion can be used while being replaced with a suitable one for each person with respect to the holding portion 5.

[Outer Engagement Portion]

Subsequently, a modified example of the outer engagement portion 9 will be described (see FIGS. 24 and 25).

Figure 24:
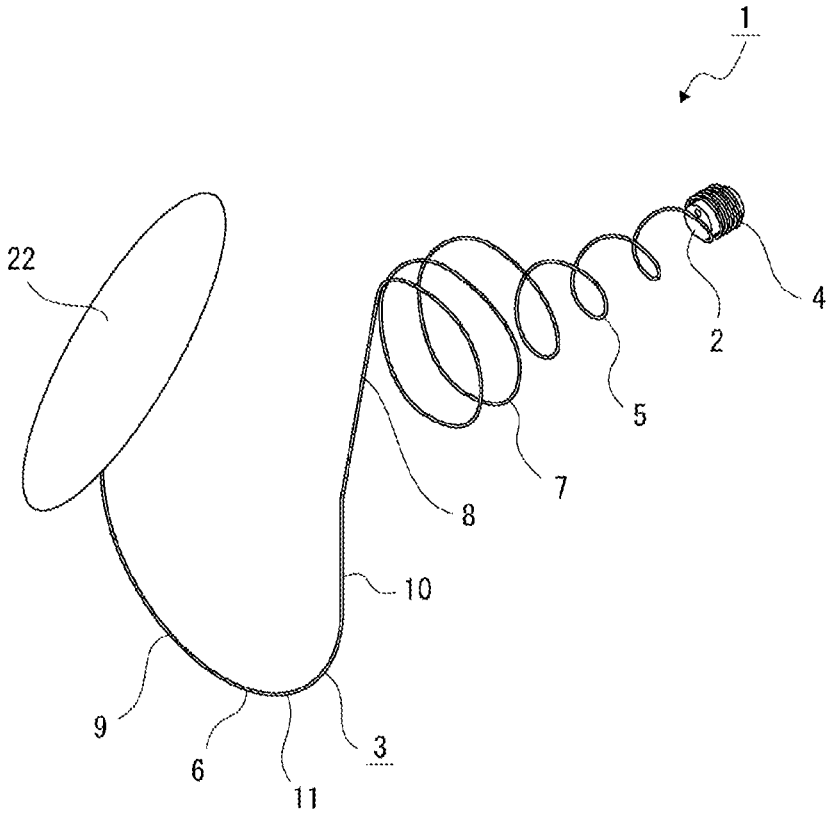
FIG. 24 is a view illustrating a first modified example of an outer engagement portion.

An outer engagement portion 9A according to a first modified example is provided with an adhesive portion 22 instead of the second acting portion 12 and the terminal end portion 13 (see FIG. 24). The adhesive portion 22 is formed in a sheet-like shape, for example, and is pasted to the back surface of the auricle 101. The adhesive portion 22 has adhesiveness that enables repeated pasting or peeling-off with respect to the auricle 101.

As described above, the sound collecting device 1 can be worn on the ear 100 by pasting the adhesive portion 22 of the outer engagement portion 9A, the sound collecting device 1 can be easily and quickly worn on the ear 100. Furthermore, since the adhesive portion 22 is pasted to the auricle 101, the entire sound collecting device 1 is hardly displaced from the ear 100, and it is possible to prevent positional deviation of the sound collecting unit 2.

Figure 25:
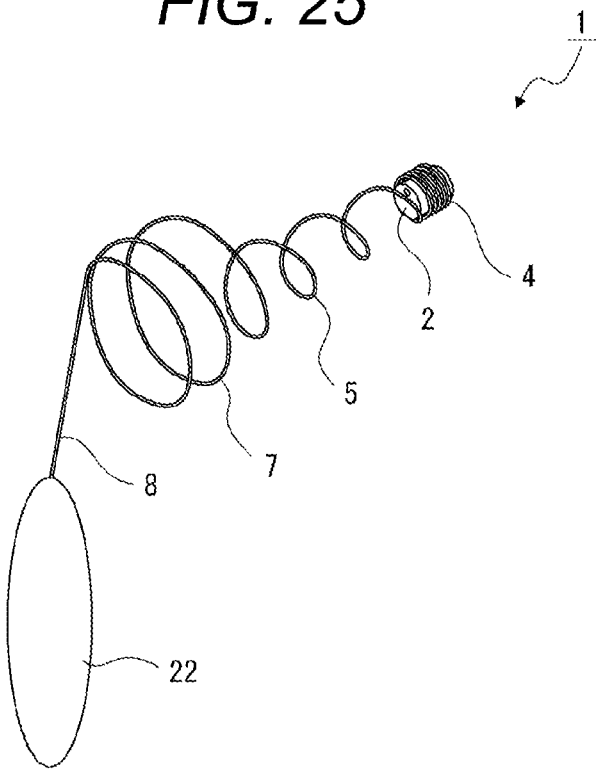
FIG. 25 is a view illustrating a second modified example of the outer engagement portion.

An outer engagement portion 9B according to a second modified example includes the adhesive portion 22 (see FIG. 25). The adhesive portion 22 is pasted to a chin, a temple, or the like.

As described above, since wearing can be performed by thus pasting the adhesive portion 22 of the outer engagement portion 9B, the sound collecting device 1 can be easily and quickly worn on the ear 100. Furthermore, since the adhesive portion 22 is pasted to the auricle 101, the entire sound collecting device 1 is hardly displaced from the ear 100, and it is possible to prevent positional deviation of the sound collecting unit 2. Moreover, since the outer engagement portion 9B includes only the adhesive portion 22, the sound collecting device 1 can be downsized and reduced in weight. Furthermore, the outer engagement portion 9B may be formed in a shape conforming to a shape of the auricle 101 or a face. Therefore, the positional deviation of the sound collecting unit 2 can be prevented.

[Connection Mode]

Next, a connection mode to connect the sound collecting device 1 for the left ear and the sound collecting device 1 for the right ear will be described (see FIGS. 26 to 29). When the sound collecting devices 1 and 1 are to be connected, a connection cord 23 that electrically connects the sound collecting units 2 and 2, and a connection member 24 that mechanically connects the device main bodies 3 and 3 are used.

The connection cord 23 includes a connecting portion 23*a* connected to various apparatuses and the like and branch portions 23*b* and 23*b* branched for left and right from the connecting portion 23*a*, and one end portion of each of the branch portions 23*b* and 23*b* is connected to each of the sound collecting units 2 and 2.

Figure 26:
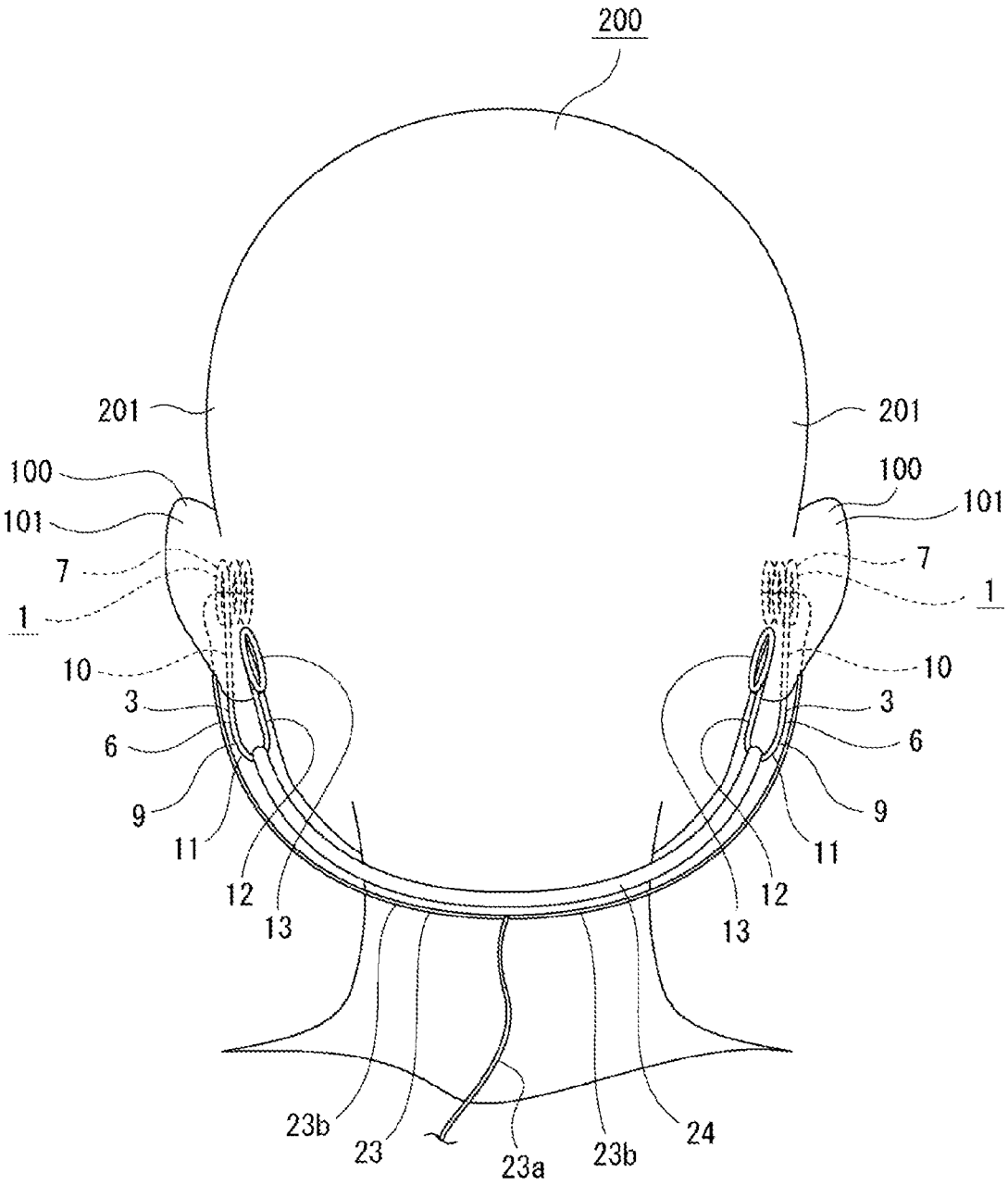
FIG. 26 is a back view illustrating a first connection mode of connecting a sound collecting device for a left ear and a sound collecting device for a right ear.

In a first connection mode, the connection cord 23 has the branch portions 23*b* and 23*b* positioned at a lower back side of an occipital region, and the connection member 24 is positioned along the branch portions 23*b* and 23*b* of the connection cord 23 at the lower back side of the occipital region (see FIG. 26). The connection member 24 has both end portions coupled to, for example, the intermediate coupling portions 11 and 11. Note that the portions where both the connection cord 23 and the connection member 24 are positioned along each other may be positioned in a joined state.

Since the right and left sound collecting devices 1 and 1 are coupled by the connection member 24, the entire sound collecting devices 1 and 1 are hardly displaced from the ears 100 and 100, respectively, and the positional deviation of the sound collecting units 2 and 2 can be prevented. Furthermore, the right and left device main bodies 3 and 3 are coupled by the connection member 24, thereby contributing to preventing one of the sound collecting devices 1 from being lost.

Figure 27:
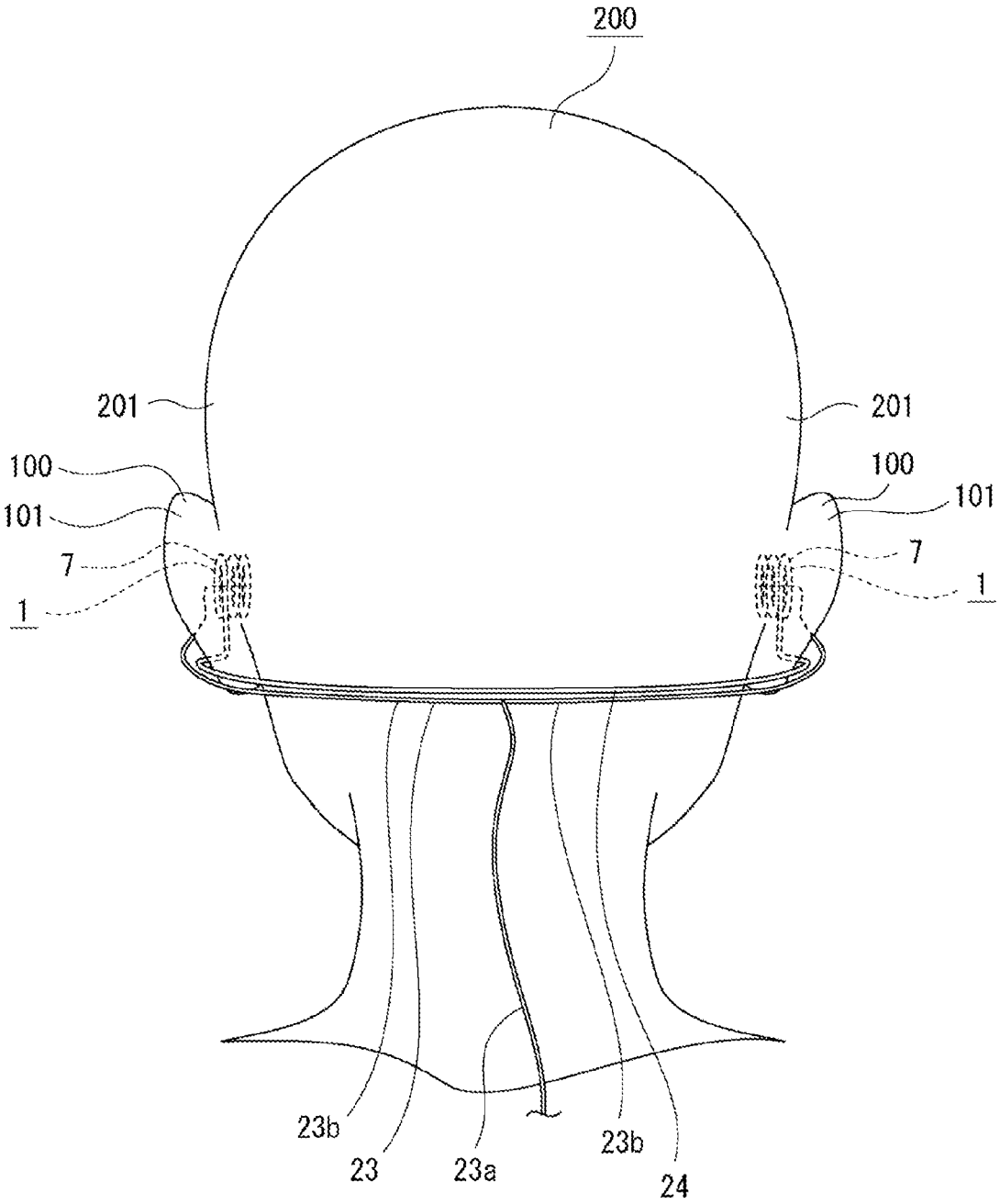
FIG. 27 is a back view illustrating a second connection mode of connecting the sound collecting device for the left ear and the sound collecting device for the right ear.
Figure 28:
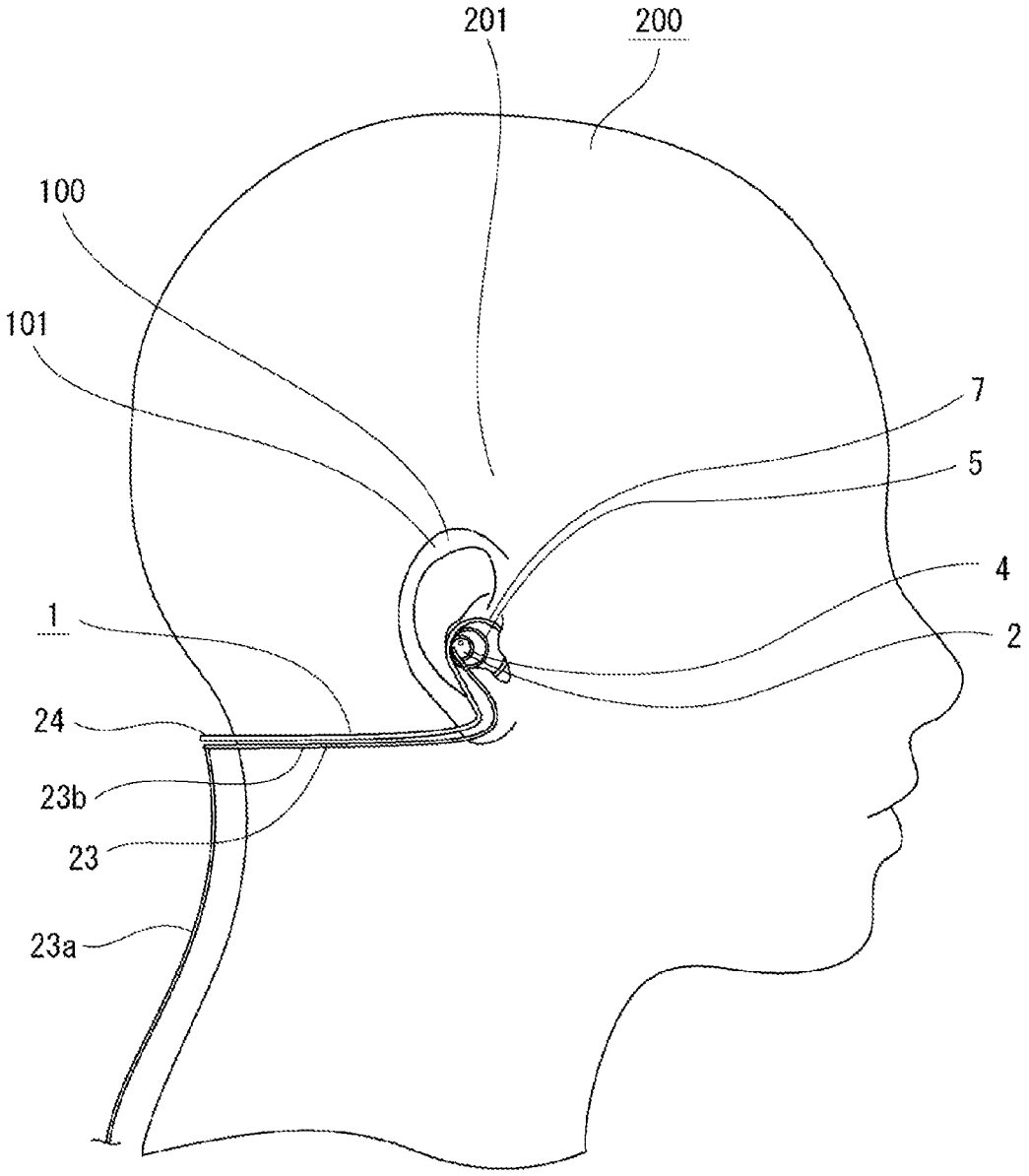
FIG. 28 is a side view illustrating the second connection mode of connecting the sound collecting device for the left ear and the sound collecting device for the right ear.

In a second connection mode, the connection cord 23 has the branch portions 23*b* and 23*b* positioned on the back side of the occipital region, and the connection member 24 is positioned on the back side of the occipital region along the connection cord 23 (see FIGS. 27 and 28). However, note that the connection member 24 is a member partly constituting the device main bodies 3 and 3, and the connection member 24 is provided instead of the outer engagement portions 9 and 9. Accordingly, the connection member 24 is provided continuously to the respective middle portions 8 and 8. Note that the connection member 24 may be integrally formed with the middle portions 8 and 8. Furthermore, the portions where both the connection cord 23 and the connection member 24 are positioned along each other may also be positioned in a joined state.

Since the connection member 24 is provided, the entire sound collecting devices 1 and 1 are hardly displaced from the ears 100 and 100, respectively, and the positional deviation of the sound collecting units 2 and 2 can be prevented. Furthermore, the connection member 24 also contributes to preventing one of the sound collecting devices 1 from being lost. Moreover, since the outer engagement portions 9 and 9 are not provided, it is possible to achieve downsizing and reduction in a manufacturing cost.

Figure 29:
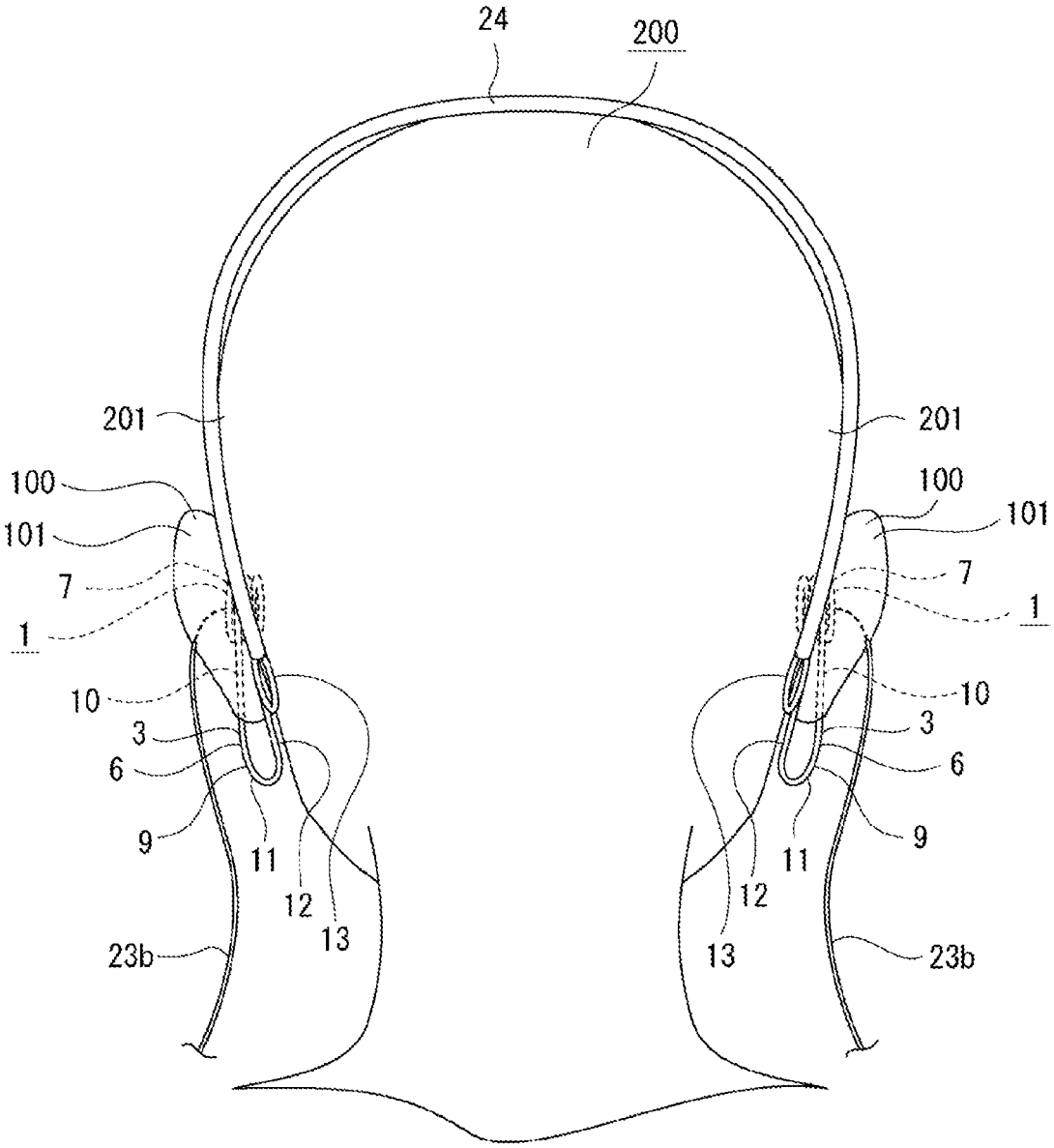
FIG. 29 is a back view illustrating a third connection mode of connecting the sound collecting device for the left ear and the sound collecting device for the right ear.

In a third connection mode, the connection cord 23 has the branch portions 23*b* and 23*b* positioned on lateral sides of the temporal regions 201 and 201, respectively, and the connection member 24 is positioned along a parietal region (see FIG. 29). The connection member 24 has both end portions coupled to, for example, the terminal end portions 13 and 13. Note that the connection member 24 may be positioned in a manner passing below the chin in the third mode.

Since the right and left sound collecting devices 1 and 1 are coupled by the connection member 24, the entire sound collecting devices 1 and 1 are hardly displaced from the ears 100 and 100, respectively, and the positional deviation of the sound collecting units 2 and 2 can be prevented. Furthermore, the right and left sound collecting devices 1 and 1 are coupled by the connection member 24, thereby contributing to preventing one of the sound collecting devices 1 from being lost.

Figure 30:
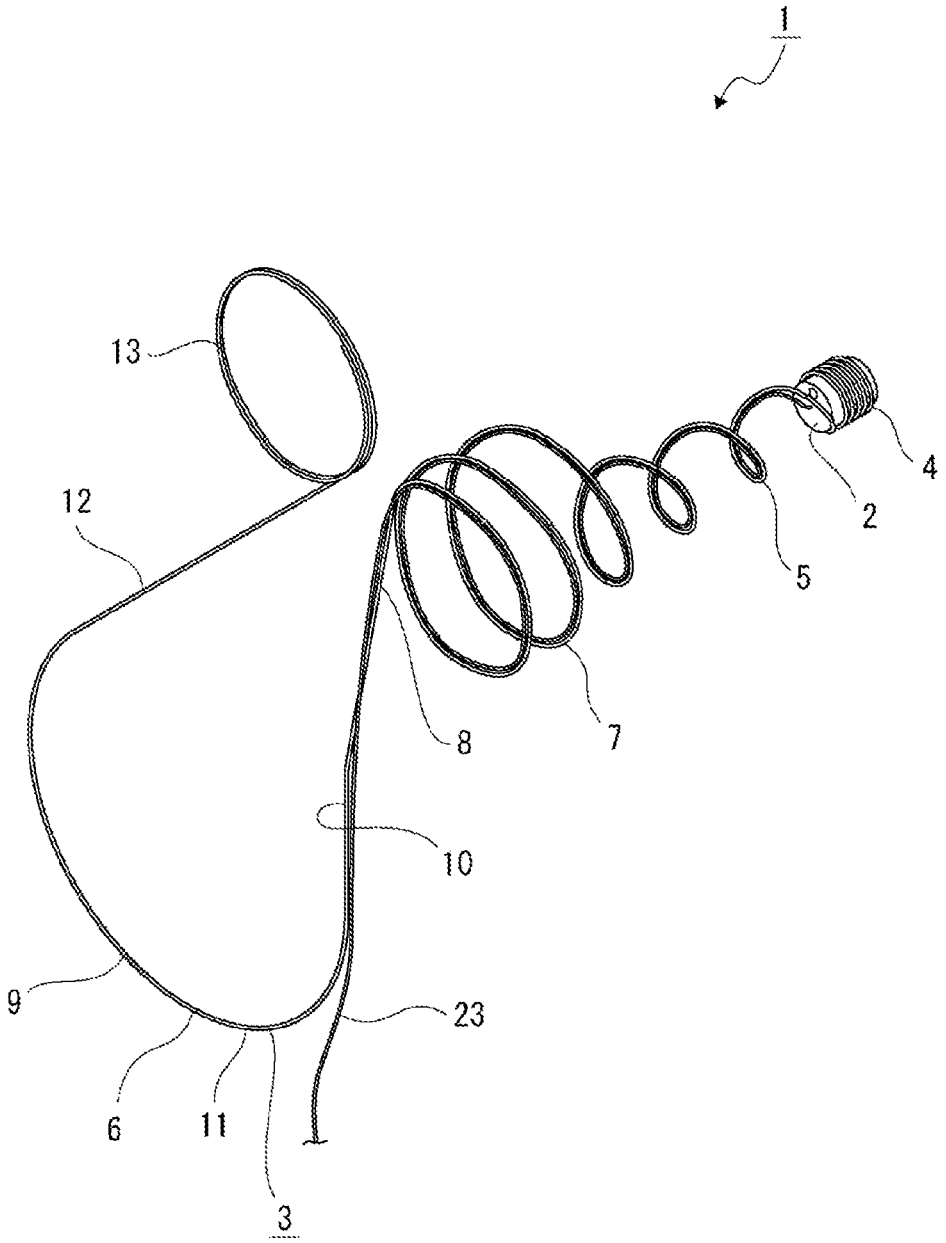
FIG. 30 is a perspective view illustrating an example in which a connection cord is positioned along a device main body.

Note that, in the first connection mode, the second connection mode, and the third connection mode described above, a part of the connection cord 23 can be positioned along or wound around at least a part of the device main body 3, for example, the attachment portion 4, the holding portion 5, the inner engagement portion 7, and the middle portion 8 (see FIG. 30).

Since the part of the connection cord 23 is thus positioned along or wound around at least the part of the device main body 3, reflection and diffraction of sound waves by the connection cord 23 are prevented, and it is possible to ensure a favorable sound input state to the sound collecting unit 2.

Figure 31:
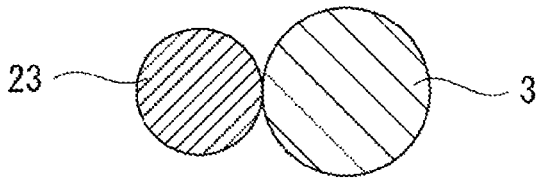
FIG. 31 is a cross-sectional view illustrating an example in which an outer peripheral surface of the connection cord and an outer peripheral surface of the device main body are joined.

Note that in the case where the part of the connection cord 23 is provided along the device main body 3, an outer peripheral surface of the connection cord 23 and an outer peripheral surface of the device main body 3 can be joined by, for example, bonding or the like (see FIG. 31). In this case, the connection cord 23 hardly separates or comes off from the device main body 3, and therefore, favorable operability of the sound collecting device 1 can be ensured.

Figure 32:
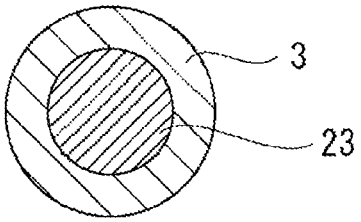
FIG. 32 is a cross-sectional view illustrating an example in which the connection cord is positioned inside the device main body.

Furthermore, the connection cord 23 can be concentrically positioned inside the device main body 3, for example (see FIG. 32). In this case also, not only the favorable operability of the sound collecting device 1 can be ensured but also durability of the connection cord 23 can be improved.

Note that in a case where the respective portions of the device main body 3 are formed by using conductors such as metal, the device main body 3 can also be used as a conductive portion. For example, a diameter of the connection cord 23 can be made small by using the device main body 3 as a ground wire and using the connection cord 23 as a signal line.

Figure 33:
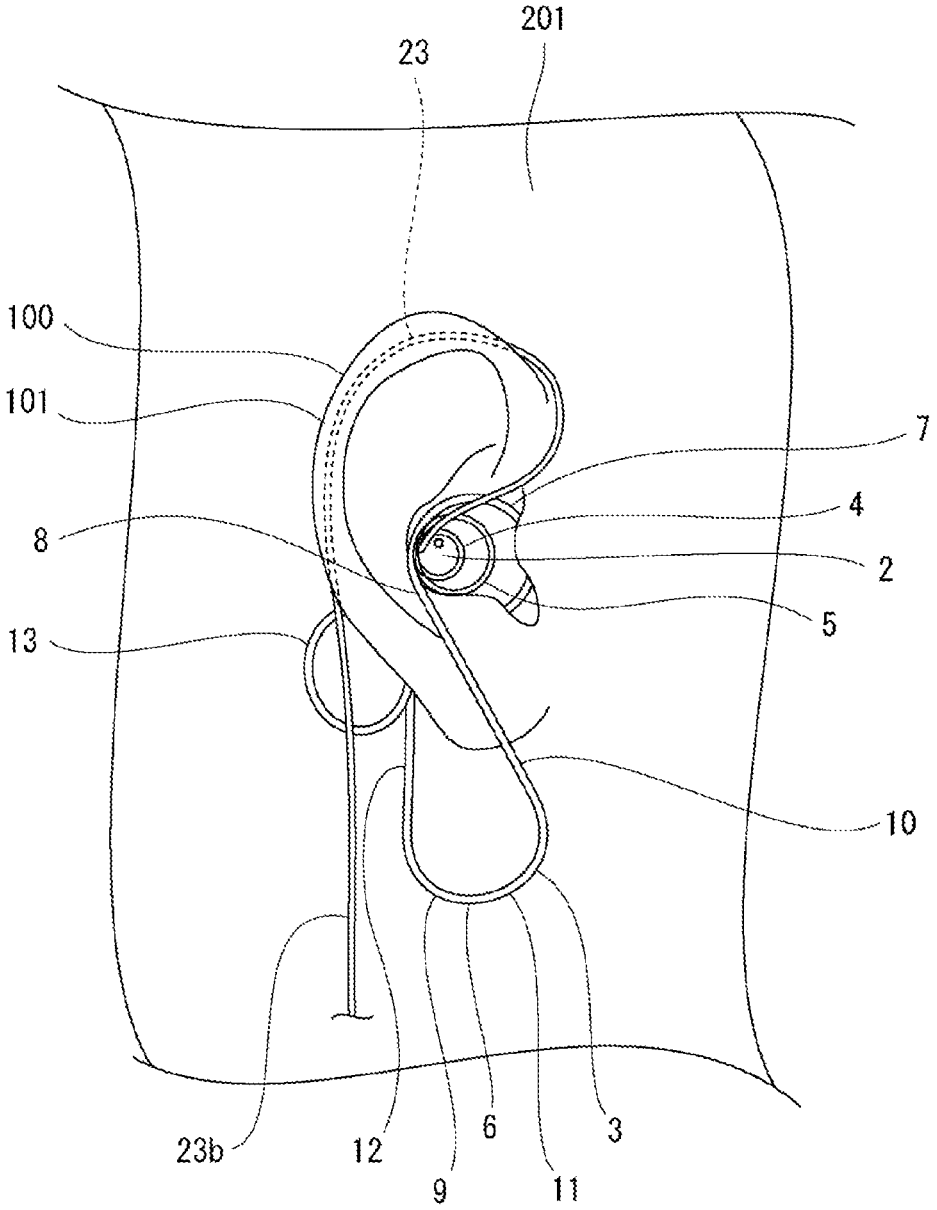
FIG. 33 is a side view illustrating an example in which the connection cord is positioned passing via an upper side of an auricle.

Furthermore, the connection cord 23 can also be positioned passing through an upper side of the auricle 101 (see FIG. 33). Since the connection cord 23 is positioned passing via the upper side of the auricle 101, the connection cord 23 is positioned on the back surface side of the auricle 101, and therefore, it is possible to suppress interference between the connection cord 23 and the sound collecting device 1.

[Others]

Subsequently, other respective configurations of the sound collecting device 1 will be described (see FIGS. 34 and 35).

Figure 34:
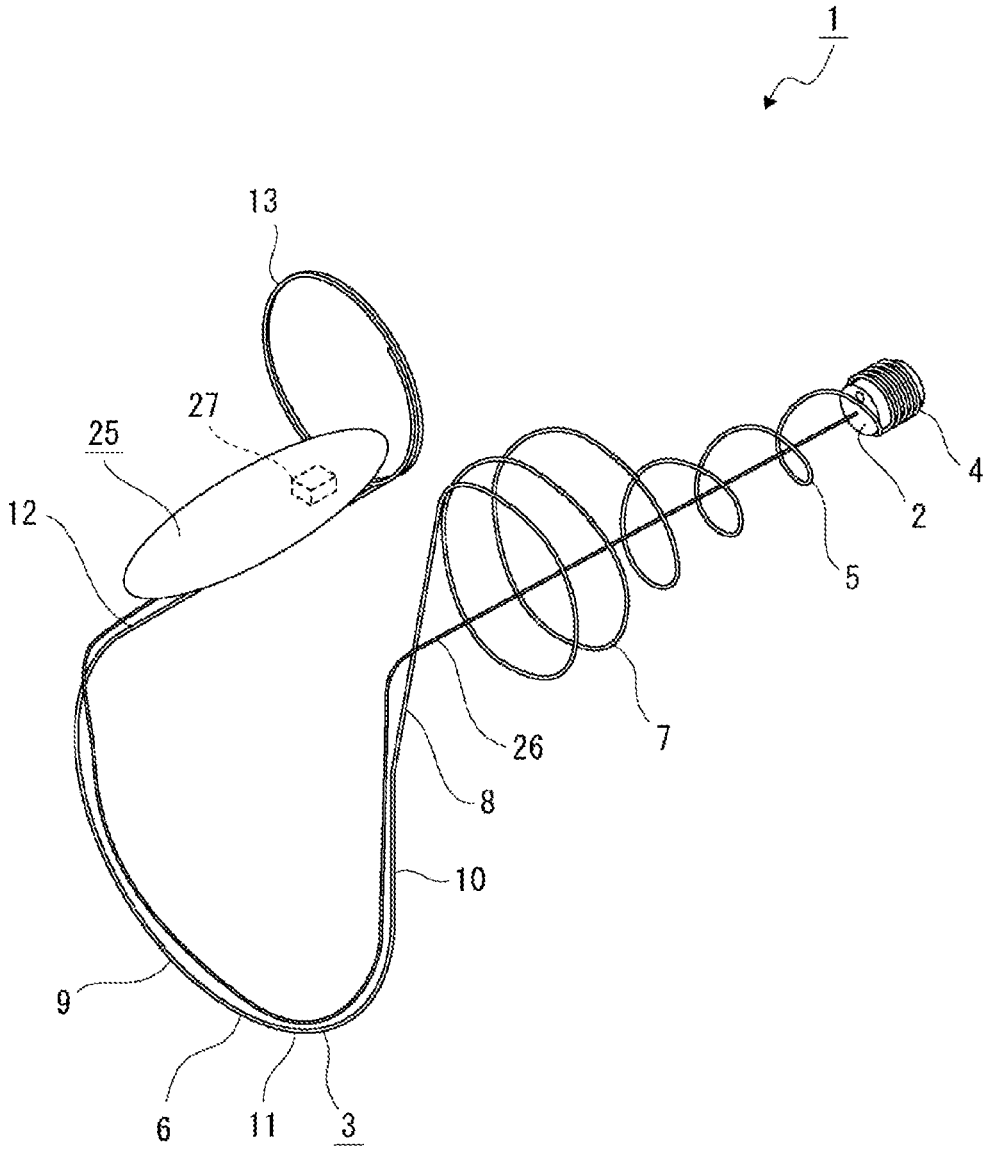
FIG. 34 is a perspective view illustrating an example in which the sound collecting unit is made wireless.

The sound collecting unit 2 can be made wireless (see FIG. 34). In this case, for example, a module 25 for wireless communication, which is pasted to or pressed against the back surface of the auricle 101, is attached to the outer engagement portion 9, and the module 25 and the sound collecting unit 2 are connected by a signal line 26. The module 25 has a battery 27 built inside. Sound input to the sound collecting unit 2 by wireless communication is transmitted to the module 25 as a sound signal via the signal line 26, and is wirelessly transmitted from the module 25 to another apparatus such as a measuring instrument.

Since the sound collecting unit 2 is made thus wireless, a connection cord for connecting the sound collecting unit 2 and a measuring instrument or the like becomes unnecessary, and a structure can be simplified.

The sound collecting device 1 may be provided with an acoustic output unit such as a speaker in addition to the sound collecting unit 2. In this case, it may be possible to provide a noise canceling function that makes the noise be hardly heard by outputting a sound signal having a phase opposite to that of an ambient sound signal (noise) input to the sound collecting unit 2.

Furthermore, a device including both the sound collecting unit 2 and the acoustic output unit may be formed by attaching, for example, the attachment portion 4 and the holding portion 5 to: an acoustic output unit such as an open-ear type earphone; or an acoustic output unit such as an earphone of a type including an ear cuff. Moreover, a device including both the sound collecting unit 2 and the acoustic output unit may be formed by attaching, to the attachment portion 4, not only the sound collecting unit 2 but also an acoustic output unit that is a balanced armature.

Moreover, a sensor may be attached to the sound collecting device 1. It is desirable that the sensor be attached to, for example, the attachment portion 4 or the holding portion 5 that is inserted into the external ear canal 113. As the sensor, for example, a sensor for distance measurement, a contact type sensor, or the like is used. Furthermore, a camera may be provided instead of the sensor.

For example, since a wearing state of the sound collecting device 1 on the ear 100 and the position of the sound collecting unit 2 with respect to the external ear canal 113 are detected by the sensor or the camera, the sound collecting unit 2 can be held at an appropriate position, and high reproducibility of the position of the sound collecting unit 2 can be ensured at the time of every measurement. Furthermore, it is also possible to align the positions of the sound collecting units 2 and 2 with respect to the external ear canals 113 and 113 in the left and right ears 100 and 100.

Furthermore, information at the time of measurement may also be detected by the sensor. For example, vital signs such as a heart rate, a pulse rate, respiration, a blood pressure, and a body temperature, of an examinee at the time of measurement, and weather information such as a temperature and a humidity, may be detected. Moreover, inclination, an inclination direction, and the like of a head 200 of an examinee may be detected by using an acceleration sensor or the like.

Moreover, for example, an actuator using a micromachine technology may be attached to the sound collecting device 1. Using the actuator makes it possible to, for example, insert the attachment portion 4 and the holding portion 5 into the external ear canal 113, control the position of the sound collecting unit 2 in the external ear canal 113, and the like. Furthermore, it is possible to determine a position of the sound collecting unit 2 at an appropriate position in the external ear canal 113 by actuating the actuator on the basis of the information detected by the sensor.

Figure 35:
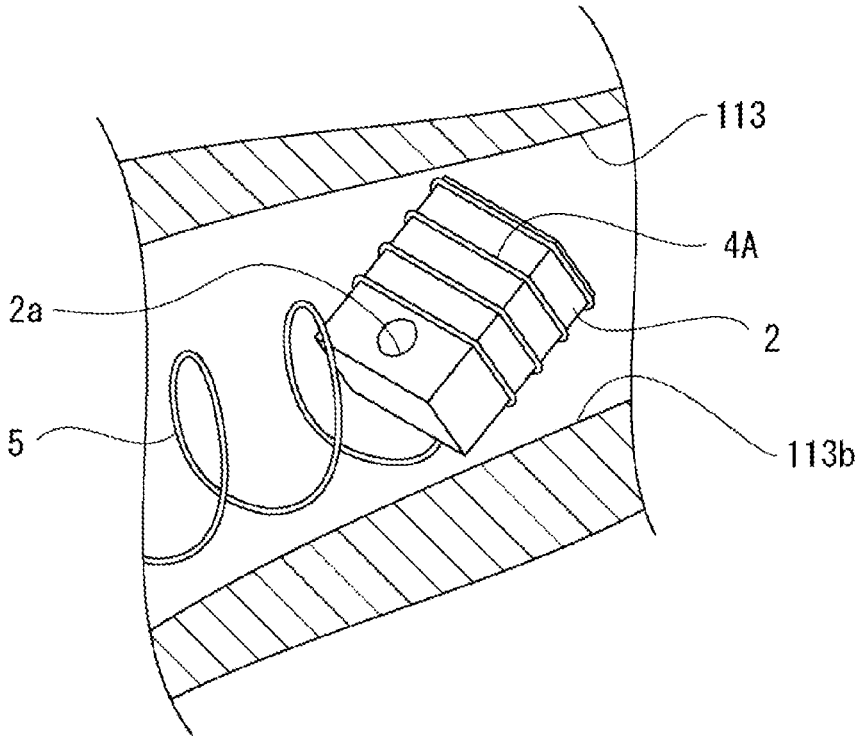
FIG. 35 is a view illustrating a state in which a MEMS microphone provided as the sound collecting unit is inserted into an external ear canal.

Furthermore, as the sound collecting unit 2, for example, a micro electro mechanical systems (MEMS) microphone or the like using a microfabrication technology may be also used (see FIG. 35). In the case where the MEMS microphone is used as the sound collecting unit 2, the MEMS microphone is formed substantially in a rectangular parallelepiped and the sound input hole 2*a* is formed on one surface in a thickness direction, and therefore, it is desirable to incline the sound collecting unit 2 such that the sound input hole 2*a* faces the external acoustic foramen 113*a* side with respect to the insertion direction into the external ear canal 113.

Since the MEMS microphone or the like is large, inserting the MEMS microphone into the external ear canal 113 is difficult in a case of aligning the thickness direction with the insertion direction into the external ear canal 113; however, the MEMS microphone can be inserted into the external ear canal 113 by inclining the same, and it is possible to ensure: a propagation path of sound to the eardrum 116 from the entrance of the external ear canal 113; and a propagation path of sound reflected at the eardrum 116 to the sound input hole 2*a*. Furthermore, since the MEMS microphone is inclined such that the sound input hole 2*a* faces the external acoustic foramen 113*a* side, a propagation path of the sound to the sound input hole 2*a* is sufficiently ensured.

Accordingly, in the case where the MEMS microphone or the like is used as the sound collecting unit 2, the sound collecting unit 2 is inclined such that the sound input hole 2*a* faces the external acoustic foramen 113*a* side with respect to the insertion direction into the external ear canal 113, and as a result, it is possible to ensure a favorable insertion property of the sound collecting unit 2 into the external ear canal 113 and further ensure a favorable sound input state to the sound collecting unit 2.

<Present Technology>

The present technology may adopt the following configurations.

(1)

A sound collecting device including:

an attachment portion that has a sound collecting unit attached and is adapted to be inserted into an external ear canal;

a holding portion adapted to be inserted into the external ear canal and hold the attachment portion at a predetermined position in the external ear canal; and a wearing portion that is positioned on an opposite side of the attachment portion while interposing the holding portion, and adapted to be at least partly engaged with an auricle, in which the attachment portion and the holding portion do not block the external ear canal and have acoustic transparency.

(2)

The sound collecting device recited in (1) above, in which the attachment portion is held in midair in the external ear canal.

(3)

The sound collecting device recited in (1) or (2) above, in which the sound collecting unit is positioned in a state in which a sound input hole is opened to an entrance side of the external ear canal.

(4)

The sound collecting device recited in any one of (1) to (3) above, in which the sound collecting unit has the sound input hole positioned on an eardrum side with respect to the entrance of the external ear canal.

(5)

The sound collecting device recited in any one of (1) to (4) above, in which the attachment portion and the holding portion are integrally formed.

(6)

The sound collecting device recited in any one of (1) to (5) above, in which the holding portion and the wearing portion are integrally formed.

(7)

The sound collecting device recited in any one of (1) to (6) above, in which the attachment portion is formed in a predetermined shape by using a linear material.

(8)

The sound collecting device recited in (7) above, in which the attachment portion is formed in a coil shape.

(9)

The sound collecting device recited in any one of (1) to (8), in which the sound collecting unit is positioned inside the attachment portion.

(10)

The sound collecting device recited in any one of (1) to (9) above, in which the sound collecting unit is detachable from the attachment portion.

(11)

The sound collecting device recited in any one of (1) to (10), in which the holding portion is formed in a predetermined shape by using a linear material.

(12)

The sound collecting device according to (11) above, in which the holding portion is formed in a coil shape.

(13)

The sound collecting device recited in any one of (1) to (12), in which the holding portion is elastically deformable.

(14)

The sound collecting device recited in any one of (1) to (13), in which the holding portion has an outer shape that becomes gradually smaller as a position of the holding portion approaches the attachment portion.

(15)

The sound collecting device recited in any one of (1) to (14) above, in which the wearing portion is formed in a predetermined shape by using a linear material.

(16)

The sound collecting device according to (15) above, in which the wearing portion is provided with an inner engagement portion continuous to the holding portion and adapted to be at least partly engaged with the auricle, and the inner engagement portion is formed in a coil shape.

(17)

The sound collecting device recited in any one of (1) to (16), in which the wearing portion is provided with an inner engagement portion continuous to the holding portion and adapted to be at least partly engaged with the auricle, the inner engagement portion is elastically deformable in a direction contacting and separating from the holding portion, and the inner engagement portion is positioned in a cavum conchae.

(18)

The sound collecting device recited in any one of (1) to (17), in which the wearing portion is provided with an inner engagement portion continuous to the holding portion and adapted to be at least partly engaged with the auricle, and an outer diameter of the inner engagement portion is formed larger than a diameter of the entrance of the external ear canal.

(19)

The sound collecting device recited in any one of (1) to (18), in which the wearing portion is provided with an outer engagement portion adapted to be partly engaged with a back surface of the auricle.

(20)

The sound collecting device recited in (19) above, in which the outer engagement portion is provided with a pair of acting portions, the outer engagement portion is elastically deformable in a direction in which the pair of acting portions contacts and separates from each other, and one of the acting portions is pressed against the back surface of the auricle.

INDUSTRIAL APPLICABILITY

In the above, the technology disclosed in the present specification has been described in detail with reference to the specific embodiment. However, it is obvious that those skilled in the art can make modifications and substitutions of the embodiment without departing from the scope of the technology disclosed in the present specification.

The sound collecting device to which the technology disclosed in the present specification is applied is used by being worn on a user's ear, but largely differs from a binaural microphone in the related art in a point of being an "open-ear type". Accordingly, in the sound collecting device to which the technology disclosed in the present specification is applied, listening characteristics for ambient sound can be made almost the same in both a wearing state and a non-wearing state, and also it is possible to: perform precise binaural recording in consideration of influence of diffraction or reflection at an inner wall of an external ear canal and influence of reflection from an eardrum; and acquire a highly accurate head-related transfer function that expresses a sound change in consideration of influence of a shape of the external ear canal and influence of reflected sound from the eardrum.

In short, the technology disclosed in the present specification has been described with the exemplified embodiment, but the content of the present specification should not be interpreted in a limited manner. The scope of the technology disclosed in the present specification should be determined in consideration of the claims.

REFERENCE SIGNS LIST

100 Ear
101 Auricle
110 Antitragus
111 Tragus
113 External ear canal
114 Cavum conchae
116 Eardrum
1 Sound collecting device
2 Sound collecting unit
2*a* Sound input hole
4 Attachment portion
5 Holding portion
6 Wearing portion
7 Inner engagement portion
9 Outer engagement portion
10 First acting portion
12 Second acting portion
4A Attachment portion
4B Attachment portion
5A Holding portion
5B Holding portion
5C Holding portion
5D Holding portion
5E Holding portion
5F Holding portion
5G Holding portion
7A Inner engagement portion

The invention claimed is:

1. A sound collecting device, comprising:

an attachment portion attached to a sound collecting unit, wherein the attachment portion is configured to be inserted into an external ear canal;

a holding portion configured to hold the attachment portion at a determined position in the external ear canal, wherein the holding portion is configured to be inserted into the external ear canal, and the holding portion has an outer shape that becomes gradually smaller as a position of the holding portion approaches the attachment portion; and a wearing portion on an opposite side of the attachment portion, wherein the holding portion is between the attachment portion and the wearing portion, the attachment portion, the holding portion, and the wearing portion do not block the external ear canal, and each of the attachment portion, the holding portion, and the wearing portion has acoustic transparency.

2. The sound collecting device according to claim 1, wherein the attachment portion is held in midair in the external ear canal.

3. The sound collecting device according to claim 1, wherein the sound collecting unit is positioned in a state in which a sound input hole is opened to an entrance side of the external ear canal.

4. The sound collecting device according to claim 1, wherein the sound collecting unit has a sound input hole positioned on an eardrum side of the external ear canal with respect to an entrance of the external ear canal.

5. The sound collecting device according to claim 1, wherein the attachment portion and the holding portion are integrally formed.

6. The sound collecting device according to claim 1, wherein the holding portion and the wearing portion are integrally formed.

7. The sound collecting device according to claim 1, wherein the attachment portion is in a determined shape, and the attachment portion includes a linear material.

8. The sound collecting device according to claim 7, wherein the attachment portion is in a coil shape.

9. The sound collecting device according to claim 1, wherein the sound collecting unit is positioned inside the attachment portion.

10. The sound collecting device according to claim 1, wherein the sound collecting unit is detachable from the attachment portion.

11. The sound collecting device according to claim 1, wherein the holding portion is in a determined shape, and the holding portion includes a linear material.

12. The sound collecting device according to claim 11, wherein the holding portion is in a coil shape.

13. The sound collecting device according to claim 1, wherein the holding portion is elastically deformable.

14. The sound collecting device according to claim 1, wherein the wearing portion is in a determined shape, and the wearing portion includes a linear material.

15. The sound collecting device according to claim 14, wherein the wearing portion includes an inner engagement portion connected to the holding portion, the wearing portion is configured to be at least partly engaged with an auricle, and the inner engagement portion is in a coil shape.

16. The sound collecting device according to claim 1, wherein the wearing portion includes an inner engagement portion connected to the holding portion, the wearing portion is configured to be at least partly engaged with an auricle, the inner engagement portion is elastically deformable in a direction in which the inner engagement portion is in contact with the holding portion and the inner engagement portion is separated from the holding portion, and the inner engagement portion is positioned in a cavum conchae.

17. The sound collecting device according to claim 1, wherein the wearing portion includes an inner engagement portion connected to the holding portion, the wearing portion is configured to be at least partly engaged with an auricle, and an outer diameter of the inner engagement portion is larger than a diameter of an entrance of the external ear canal.

18. The sound collecting device according to claim 17, wherein the wearing portion includes an outer engagement portion, and the outer engagement portion is configured to be partly engaged with a back surface of the auricle.

19. The sound collecting device according to claim 18, wherein the outer engagement portion includes a pair of acting portions, the outer engagement portion is elastically deformable in a direction in which a first acting portion of the pair of acting portions contacts and separates from a second acting portion of the pair of acting portions, and one of the pair of acting portions is pressed against the back surface of the auricle.

20. A sound collecting device, comprising:

an attachment portion attached to a sound collecting unit, wherein the attachment portion is configured to be inserted into an external ear canal;

a holding portion configured to hold the attachment portion at a determined position in the external ear canal, wherein the holding portion is configured to be inserted into the external ear canal; and a wearing portion on an opposite side of the attachment portion, wherein the holding portion is between the attachment portion and the wearing portion, the wearing portion includes an inner engagement portion connected to the holding portion, an outer diameter of the inner engagement portion is larger than a diameter of an entrance of the external ear canal, the attachment portion, the holding portion, and the wearing portion do not block the external ear canal, and each of the attachment portion, the holding portion, and the wearing portion has acoustic transparency.

* * * * *